US011420440B2

(12) United States Patent
Sato et al.

(10) Patent No.: US 11,420,440 B2
(45) Date of Patent: Aug. 23, 2022

(54) INKJET HEAD AND METHOD FOR PRODUCING SAME

(71) Applicant: KONICA MINOLTA, INC., Tokyo (JP)

(72) Inventors: Yohei Sato, Hachioji (JP); Shinichi Kawaguchi, Sagamihara (JP); Akihisa Yamada, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 17 days.

(21) Appl. No.: 17/040,294

(22) PCT Filed: Mar. 22, 2018

(86) PCT No.: PCT/JP2018/011428
§ 371 (c)(1),
(2) Date: Sep. 22, 2020

(87) PCT Pub. No.: WO2019/180882
PCT Pub. Date: Sep. 26, 2019

(65) Prior Publication Data

US 2021/0016572 A1 Jan. 21, 2021

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1646* (2013.01)

(58) Field of Classification Search
CPC ..... B41J 2/14233; B41J 2/161; B41J 2/1646; B41J 2/1606; B41J 2/1623; B41J 2/1629; B41J 2/1631; B41J 2/1642; B41J 2/1645; B41J 2002/14491; B41J 2/14209
See application file for complete search history.

(56) References Cited

U.S. PATENT DOCUMENTS

2009/0207214 A1 8/2009 Yagi et al.
2010/0238237 A1 9/2010 Seki

FOREIGN PATENT DOCUMENTS

JP H08295018 A 11/1996
JP 2003019797 A 1/2003
JP 2009233927 A 10/2009
JP 2010188715 A 9/2010
JP 2010214895 A 9/2010
(Continued)

OTHER PUBLICATIONS

IP.com search (Year: 2021).*
(Continued)

*Primary Examiner* — Lisa Solomon
(74) *Attorney, Agent, or Firm* — Cantor Colburn LLP

(57) ABSTRACT

An inkjet head having a metal wiring on a board in an ink flow path or an ink tank includes a base layer and an organic protective layer on the metal wiring, arranged in an order of the metal wiring, the base layer, and the organic protective layer. The base layer has an interface that is in contact with the metal wiring and that includes at least one of a metal oxide and a metal nitride. The base layer has an interface that is in contact with the organic protective layer and that includes at least one of a silicon oxide and a silicon nitride.

15 Claims, 8 Drawing Sheets

(56) References Cited

FOREIGN PATENT DOCUMENTS

| | | | |
|---|---|---|---|
| JP | 2012116054 | A | 6/2012 |
| JP | 2003019797 | A | 1/2021 |

OTHER PUBLICATIONS

JPO Notice of Reasons for Refusal for corresponding JP Application No. 2020-507218; dated Oct. 19, 2021.
EPO Extended European Search Report for corresponding EP Application No. 18911022.4; dated Feb. 18, 2021.
International Search Report for International Application No. PCT/JP2018/011428; dated May 22, 2018.
CNIPA First Office Action for corresponding CN Application No. 201880091416.5, dated May 28, 2021.
CNIPA The Second Office Action for corresponding CN Application No. 201880091416.5; dated Jan. 14, 2022.
PCT International Preliminary Report on Patentability, dated Sep. 22, 2020; and Written Opinion of the International Searching Authority; dated May 22, 2018, for International Application No. PCT/JP2018/011428.

* cited by examiner

INKJET HEAD AND METHOD FOR PRODUCING SAME

CROSS REFERENCE TO RELATED APPLICATIONS

This is the U.S. national stage of application No. PCT/JP2018/011428, filed on Mar. 22, 2018. The entire contents of which being incorporated herein by reference.

TECHNICAL FIELD

The present invention relates to an inkjet head and a manufacturing method thereof. More specifically, the present invention relates to an inkjet head in which the adhesion between metal wiring as an electrode and an organic protective layer formed thereon is improved, and the ink durability of the metal wiring is improved, and a manufacturing method thereof.

BACKGROUND ART

The electrodes for driving the actuators of the inkjet head need to be wired in the ink flow path and the ink tank in order to wire them in high density. In particular, because an inkjet head using a share mode type piezoelectric element has a structure in which the piezoelectric element is used as an ink flow path, metal wiring that functions as an electrode is necessarily formed in the ink flow path. When the metal wiring comes into contact with ink, corrosion or leak between wirings via the ink occurs. In order to suppress them, a structure in which an organic protective layer is formed on metal wiring has been proposed.

Conventionally, as an organic protective layer material from the viewpoint of chemical resistance, an example in which an organic protective layer material such as polyparaxylylene is used has been known. Furthermore, Patent Document 1 discloses an example in which a silane coupling agent is used in order that durability against ink (adhesion to metal wiring) is improved. The use of the silane coupling agent is highly effective for compounds forming siloxane bonds such as silicon oxide. However, when used for a material of metal wiring (in particular, noble metal such as gold, platinum, or copper), good adhesion cannot be obtained, that is, there is a problem of low durability to ink.

Patent Document 2 discloses a configuration in which a base layer containing a silicon oxide is formed on metal wiring for the purpose of preventing the occurrence of pinholes in the organic protective layer. Patent Document 3 discloses a configuration in which an inorganic insulating layer containing silicon oxide is formed on metal wiring, and an organic protective layer such as polyparaxylylene is laminated on the inorganic insulating layer in order to suppress the electrode exposure during laser processing.

However, the adhesion between the metal wiring and the silicon oxide is poor, and there occurs peeling immediately after layer formation, ink penetration at the interface after long-term dipping in ink, or the like. As a result, there has been a problem of insufficient reliability or instability required as an inkjet head due to peeling of layer and electric leak.

CITATION LIST

Patent Literature

[Patent Document 1] JP 2003-019797 A
[Patent Document 2] JP 2012-116054 A
[Patent Document 3] JP 2010-214895 A

SUMMARY OF INVENTION

Technical Problem

The present invention has been made in view of the above problems and circumstances, and the problem to be solved is to provide an inkjet head in which the adhesion between metal wiring and an organic protective layer formed thereon is improved, and the ink durability of the metal wiring is improved, and a manufacturing method thereof.

Solution to Problem

The present inventors have found out the following in the process of examining the cause of the above problems and the like in order to solve the above problems. By providing a base layer containing a specific compound between the metal wiring and the organic protective layer, the adhesion between the metal wiring and the organic protective layer formed thereon is improved. As a result, an inkjet head having metal wiring with improved ink durability can be obtained.

That is, the above-mentioned subject concerning the present invention is solved by the following means.

1. An inkjet head having a metal wiring on a board in an ink flow path or an ink tank, including a base layer and an organic protective layer on the metal wiring, arranged in an order of the metal wiring, the base layer, and the organic protective layer, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride.

2. The inkjet head according to item 1, wherein the base layer has a laminated structure including two or more layers, one of the two or more layers is in contact with the metal wiring and includes at least one of a metal oxide and a metal nitride, and another of the two or more layers is in contact with the organic protective layer and includes at least one of a silicon oxide and a silicon nitride.

3. The inkjet head according to item 1, wherein the base layer includes a mixture of the metal oxide or metal nitride and the silicon oxide or silicon nitride, and at least one of a composition ratio of the metal and a composition ratio of the silicon has a gradient in a layer thickness direction.

4. The inkjet head according to item 1, wherein the base layer includes a mixture of the metal oxide or metal nitride and the silicon oxide or silicon nitride, and both a composition ratio of the metal and a composition ratio of the silicon are uniform in a layer thickness direction.

5. The inkjet head according to any one of items 1 to 4, wherein, in the base layer, a composition ratio of the metal at an interface that is in contact with the metal wiring is in a range of 1 to 50 at %, and a composition ratio of the silicon at an interface that is in contact with the organic protective layer is in a range of 1 to 50 at %.

6. The inkjet head according to any one of items 1 to 5, wherein the base layer has a layer thickness within a range of 0.1 nm to 10 μm.

7. The inkjet head according to any one of items 1 to 6, wherein metal of the metal wiring is gold, platinum or copper.

8. The inkjet head according to any one of items 1 to 7, wherein metal of the metal oxide or the metal nitride is titanium, zirconium, tantalum, chromium, nickel or aluminum.

9. The inkjet head according to any one of items 1 to 8, wherein the silicon oxide is silicon dioxide.

10. The inkjet head according to any one of items 1 to 9, wherein the organic protective layer includes a silane coupling agent or is adjacent to an adhesive layer including a silane coupling agent, the adhesive layer being between the organic protective layer and the base layer.

11. The inkjet head according to any one of items 1 to 10, wherein the organic protective layer includes polyparaxylylene, derivative of polyparaxylylene, polyimide, or polyuria.

12. A method of producing the inkjet head according to any one of items 1 to 11, including, in formation of the base layer, a pretreatment including degreasing cleaning, plasma treatment, or reverse sputtering treatment.

Advantageous Effects of Invention

According to the present invention described above, it is possible to provide an inkjet head in which the adhesion between metal wiring and an organic protective layer formed thereon is improved, and the ink durability of the metal wiring is improved, and a manufacturing method thereof.

The mechanism that exerts the effects of the present invention or how the present invention works is not clear yet, but it is presumed as follows.

The metal wiring according to the present invention is an electrode for driving the actuator of the inkjet head, and is formed in the ink flow path or the ink tank to increase the density. In order to protect the metal wiring from contact with ink, an organic protective layer such as polyparaxylylene having high insulation and high chemical resistance (high ink durability in the present invention) is formed on the electrode. However, the adhesion between the metal wiring and the organic protective layer is poor, and there occurs peeling immediately after layer formation, ink penetration at the interface after long-term dipping in ink, or the like. As a result, there has been a problem peeling of layer and electric leak.

The inkjet head of the present invention is characterized in that, in order to ensure adhesion between the metal wiring and the organic protective layer, the metal wiring formed in the ink flow path or in the ink tank of the inkjet head has a base layer having high adhesion to both the metal wiring and the organic protective layer.

Such a base layer has at least a metal oxide or a metal nitride having high adhesiveness to the metal wiring arranged at an interface in contact with the metal wiring. In addition, such a base layer has the silicon oxide or the silicon nitride having adhesion between the metal oxide or metal nitride and the organic protective layer at an interface in contact with the organic protective layer. The base layer having such a structure is presumed to be able to improve the adhesion between the metal wiring and the organic protective layer significantly and to suppress adhesion between the layers due to peeling between layers and penetration of ink, corrosion of the metal wiring, and electrical leakage. It is possible to further improve the adhesion by including a silane coupling agent in the protective layer or by having an adhesive layer containing a silane coupling agent as an adjacent layer between the organic protective layer and the base layer. In addition, since the metal oxide or the metal nitride has the property of being highly corrosive to ink, it is presumed that the protection function of the metal wiring is enhanced. The metal oxide or metal nitride is highly corrosive to ink, which is also presumed to enhance the function of protecting metal wiring.

DESCRIPTION OF EMBODIMENTS

Figure 1A:
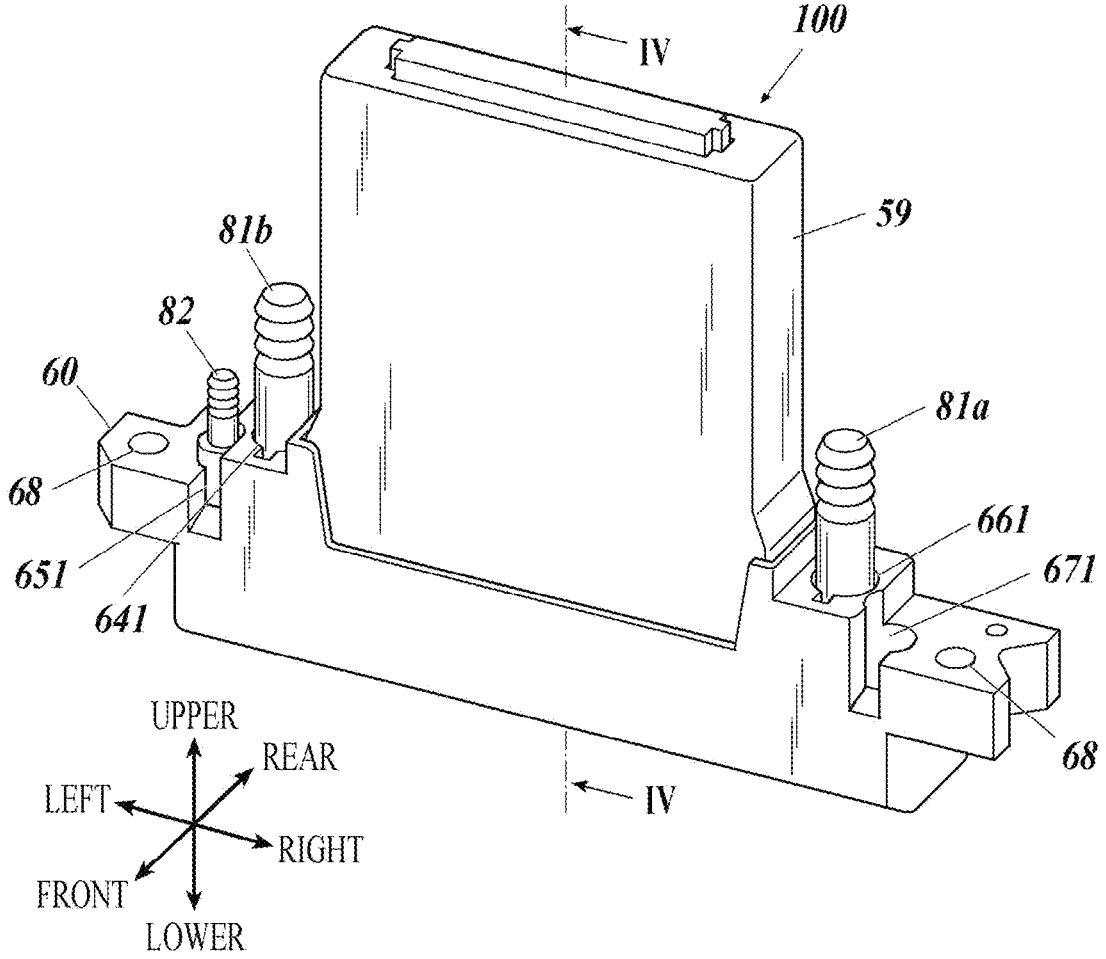
FIG. 1A is a perspective view showing an example of an inkjet head.

The inkjet head of the present invention is an inkjet head having a metal wiring on a board in an ink flow path or an ink tank, including a base layer and an organic protective layer on the metal wiring, arranged in an order of the metal wiring, the base layer, and the organic protective layer. The base layer has an interface that is in contact with the metal wiring and that includes at least one of a metal oxide and a metal nitride. The base layer has an interface that is in contact with the organic protective layer and that includes at least one of a silicon oxide and a silicon nitride. This feature is a technical feature common to or corresponding to the following embodiments.

As a preferred embodiment of the present invention, from the viewpoint of the effect expression of the present invention, the base layer has a laminated structure including two or more layers, one of the two or more layers is in contact with the metal wiring and includes at least one of a metal oxide and a metal nitride, and another of the two or more layers is in contact with the organic protective layer and includes at least one of a silicon oxide and a silicon nitride. This improves the adhesion between the metal wiring and the organic protective layer and the durability of the metal wiring to ink.

In order to exhibit the effects of the present invention, preferably, the base layer includes a mixture of the metal oxide or metal nitride and the silicon oxide or silicon nitride, and at least one of a composition ratio of the metal and a composition ratio of the silicon has a gradient in a layer thickness direction. According to this configuration, the interface in contact with the metal wiring mainly contains the metal, and the interface in contact with the organic protective layer mainly contains the silicon. This structure can be realized in a single layer by the composition ratio(s) having gradient(s). Therefore, since the number of layers can be reduced, productivity can be improved.

Furthermore, preferably, the base layer includes a mixture of the metal oxide or metal nitride and the silicon oxide or silicon nitride, and both a composition ratio of the metal and a composition ratio of the silicon are uniform in a layer thickness direction. According to this configuration, for example, the base layer according to the present invention can be more easily formed by using a metal silicate in which a metal and silicon are mixed as a raw material. Thereby, the adhesion between the metal wiring and the organic protective layer and the ink durability can be improved.

In the above three embodiments, in the base layer according to the present invention, preferably, a composition ratio of the metal at an interface that is in contact with the metal wiring is in a range of 1 to 50 at %, and a composition ratio of the silicon at an interface that is in contact with the organic protective layer is in a range of 1 to 50 at %. When the composition ratio of metal of silicon in the base layer is 1 at % or more, the effects of the present invention can be exhibited. When it is 50 at % or less, it is possible to suppress the physical strength reduction of the base layer such as peeling of layer due to excessive metal or silicon in the interface. The adhesion between the metal wiring and the organic protective layer and the ink durability can be further improved.

Preferably, the base layer has a layer thickness within a range of 0.1 nm to 10 μm. From the viewpoint of expressing the effects of the present invention, it may be a monomolecular layer having a layer thickness of about 0.1 nm. The layer thickness is preferably 10 μm or less because failure such as peeling of layer and warping of the board due to layer stress does not occur. When the base layer has two or more layers, the total thickness of the layers is preferably in the range of 0.1 nm to 10 μm.

Preferably, the metal of the metal wiring is noble metal such as gold, platinum, and copper. This makes it easier to obtain the effect of the present invention of improving adhesion and durability to ink.

Preferably, in the oxide or nitride including metal atom, the metal atom is titanium, zirconium, tantalum, chromium, nickel, or aluminum. This makes the adhesion to the metal wiring stronger.

Preferably, the silicon oxide is silicon dioxide from the viewpoint of further strengthening the adhesion of the organic protective layer, Preferably, the organic protective layer includes a silane coupling agent or is adjacent to an adhesive layer including a silane coupling agent, and the adhesive layer being between the organic protective layer and the base layer. As a result, the silane coupling agent and the silicon in the base layer form a siloxane bond, and stronger adhesion can be exhibited.

Preferably, the organic protective layer includes polyparaxylylene, derivative of polyparaxylylene, polyimide, or polyuria from the viewpoint of the excellent protecting function of metal wiring.

A method of producing the inkjet head of the present invention includes, in formation of the base layer, a pretreatment including degreasing cleaning, plasma treatment, or reverse sputtering treatment. Thereby, more excellent adhesion and durability can be exhibited.

Hereinafter, detailed description on the present invention and its constituents, and on the embodiments/aspects for carrying out the present invention will be made. In the present application, "to" is used with the meaning that numerical values written before and after it are included as a lower limit value and an upper limit value, respectively.

<<Outline of Inkjet Head of Present Invention>>

The inkjet head of the present invention has a metal wiring on a board in an ink flow path or an ink tank, and includes a base layer and an organic protective layer on the metal wiring, arranged in an order of the metal wiring, the base layer, and the organic protective layer, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride.

In the present invention, the metal in the "metal oxide or metal nitride" does not include silicon, which is a metalloid element of Group 14 in the long periodic table. Silicon is treated as a non-metal element unless otherwise specified. The base layer according to the present invention is characterized by inclusion of the metal so as to exhibit the function of improving adhesion between the base layer and the metal wiring, and by inclusion of silicon so as to exhibit the function of improving adhesion between the base layer and the organic protective layer. Therefore, in view of their functions, "metal" and "silicon" are treated as different kinds of materials in the present invention.

The "interface" means a region within 0.1 nm in the thickness direction from the surface of the base layer when the metal oxide or metal nitride and the silicon oxide or silicon nitride form respective monomolecular layers on the surfaces where the base layer contacts the metal wiring and the organic protective layer. Alternatively, when they do not form monomolecular layers and the thickness of the base layer is less than 10 nm, the "interface" means a region within the thickness of the base layer from the surface. Alternatively, when they do not form monomolecular layers and the thickness of the base layer is 10 nm or more, the "interface" means a region within 10 nm in the thickness direction from the surface.

In the present invention, the "metal composition ratio" of the metal oxide or metal nitride and the "silicon composition ratio" of a silicon oxide or metal nitride are defined as respective atomic concentrations (unit: at %) of the metal and silicon in the base layer interface. For example, when a silicon compound of a base layer produced under a certain condition is silicon dioxide ($SiO_2$), the composition analysis values of Si=33.3 at % and O=66.7 at % are obtained by XPS measurement described later. In this way, the composition ratio of silicon, 33.3 at %, can be grasped as a quantifiable physical quantity. Similarly, when a metal oxide of the base layer produced under a certain condition is titanium oxide ($TiO_2$), the analysis values of Ti=33.3 at % and O=66.7 at % are obtained, and when tantalum silicate ($TaSi_xO_y$) as a metal silicate is produced, the analysis values of Ta=25.0 at %, Si=15.0 at %, and O=60.0 at % are obtained. Thus, the presence of metal and silicon in the base layer interface and the atomic concentration can be quantitatively determined.

[1] Configuration of Inkjet Head of Present Invention

[1.1] Schematic Configuration

Preferred embodiments of the configuration of the inkjet head of the present invention will be described with reference to the accompanying drawings. However, the present invention is not limited to the illustrated examples.

Figure 1B:
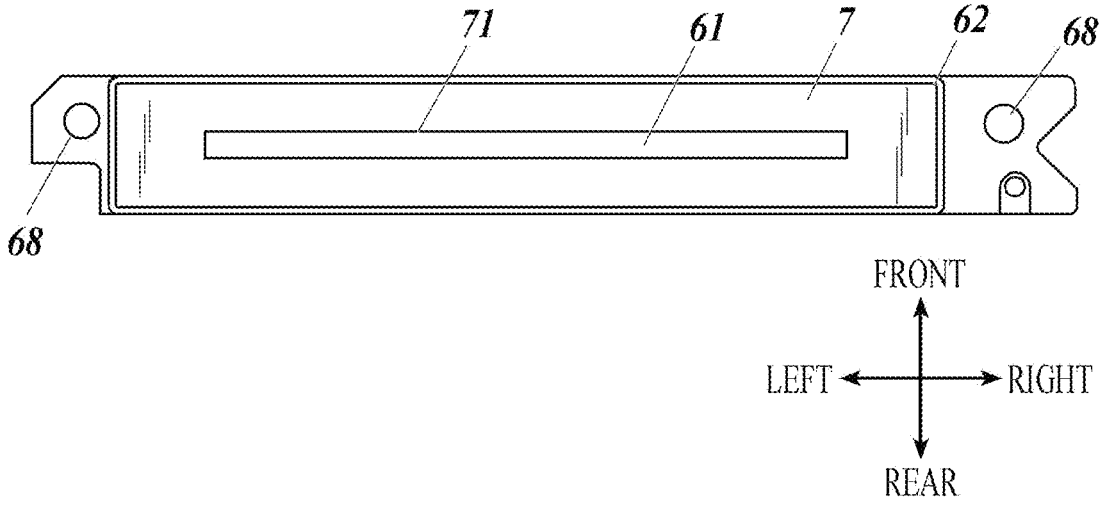
FIG. 1B is a bottom view of the inkjet head.
Figure 2:
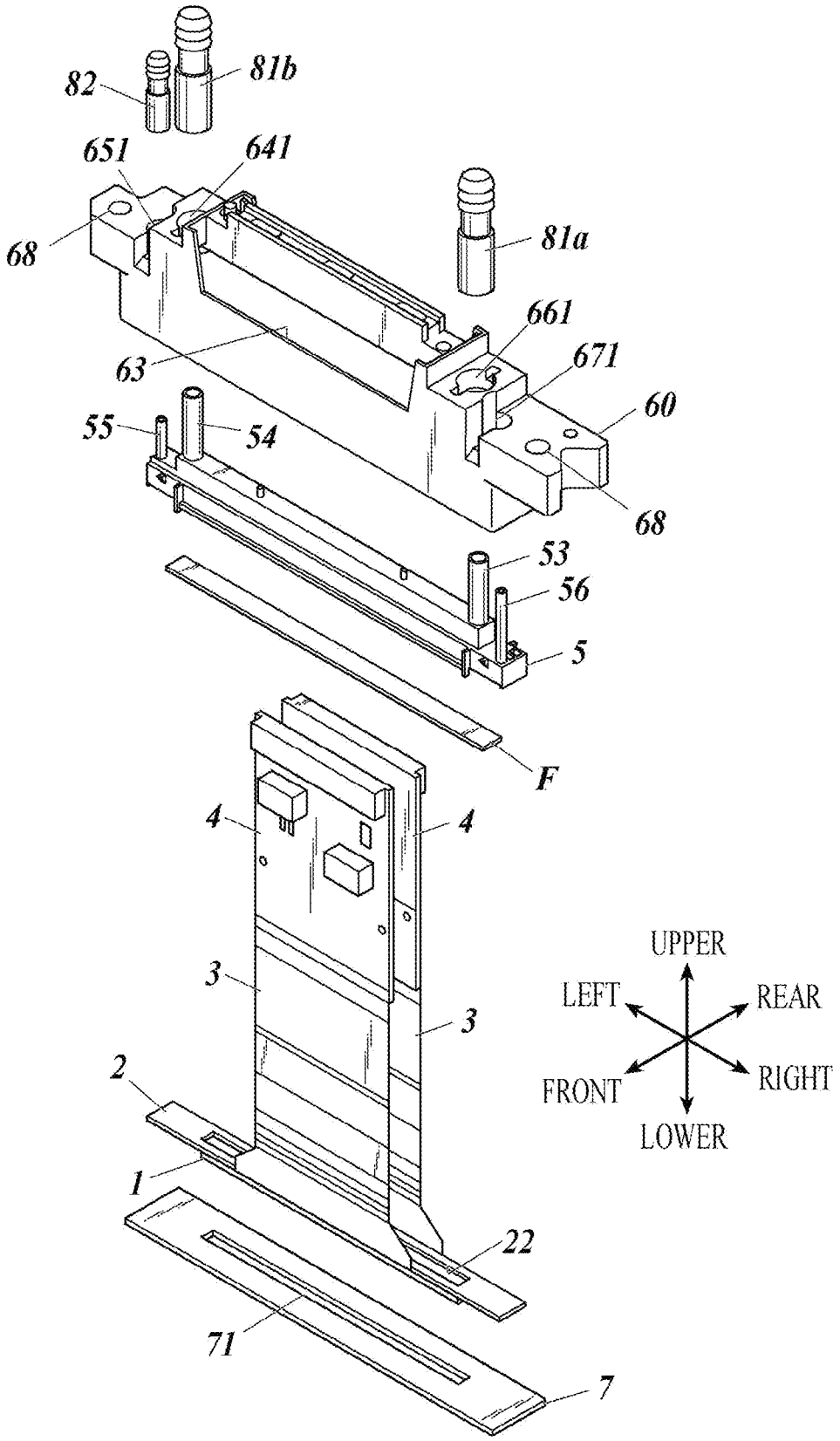
FIG. 2 is an exploded perspective view showing an example of an inkjet head.

FIG. 1 shows a schematic configuration of an inkjet head which is an embodiment of the present invention including a perspective view (FIG. 1A) and a bottom view (FIG. 1B). FIG. 2 is an exploded perspective view of the inkjet head shown in FIG. 1. Hereinafter, description will be given with reference to FIG. 1 and FIG. 2.

An inkjet head (100) applicable to the present invention is mounted on an inkjet printer (not shown), and includes: ahead chip (1) that ejects ink described later from nozzles (13); a wiring board (2) on which the head chip is arranged; drive circuit boards (4) connected to the wiring board via flexible printed boards (3) (also called FPC (Flexible printed circuits)); a manifold (5) that introduces ink into channels of the head chip through a filter (F); a casing (60) inside of which a manifold is housed; a cap receiving plate (7) attached so as to close the bottom opening of the housing (60); first and second joints (81*a*, 81*b*) attached to first and second ink ports of the manifold; a third joint (82) attached to a third ink port of the manifold; and a cover (59) attached to the housing (60). Attachment holes (68) are formed for attaching the casing (60) to the printer body. Reference numerals (641), (651), (661), and (671) each denote a recess for attachment.

The cap receiving plate (7) shown in FIG. 1B is formed as a substantially rectangular plate having an outer shape that is long in the left-right direction corresponding to the shape of a cap receiving plate attachment portion (62). The cap receiving plate (7) is provided with a nozzle opening (71) that is long in the left-right direction at the substantially middle portion in order to expose a nozzle plate (61) in which nozzles (13) are arranged.

FIG. 2 is an exploded perspective view showing an example of the inkjet head.

Inside the inkjet head (100) are arranged a wiring board (2) that is in contact with the head chip (1) and on which the metal wiring according to the present invention is formed, the flexible printed boards (3), and the drive circuit boards (4) Inside the drive circuit board (4) is a manifold (5) including a filter (F) and a common ink chamber (6) (also called an ink tank) in which ink ports (53) to (56) are arranged. The ink ports introduce ink into the common ink chamber (6), for example.

The drive circuit board (4) is composed of an IC (Integrated Circuit) or the like, and has a power supply side terminal that outputs a drive current to be supplied to a piezoelectric element and a ground side terminal that is grounded and into which current flows. As a result, the piezoelectric element is supplied with electricity (driving potential) and is displaced.

Other than the representative example of the inkjet head is as shown in FIG. 1 and FIG. 2, for example, inkjet heads having configurations described below can be appropriately selected and used: JP2012-140017A, JP2013-010227A, JP2014-058171A, JP2014-097644A, JP2015-142979A, JP2015-142980A, JP2016-002675A, JP2016-002682A, JP2016-107401A, JP2017-109476A, and JP2017-177626A.

[1.2] Internal Structure of Inkjet Head

Figure 3:
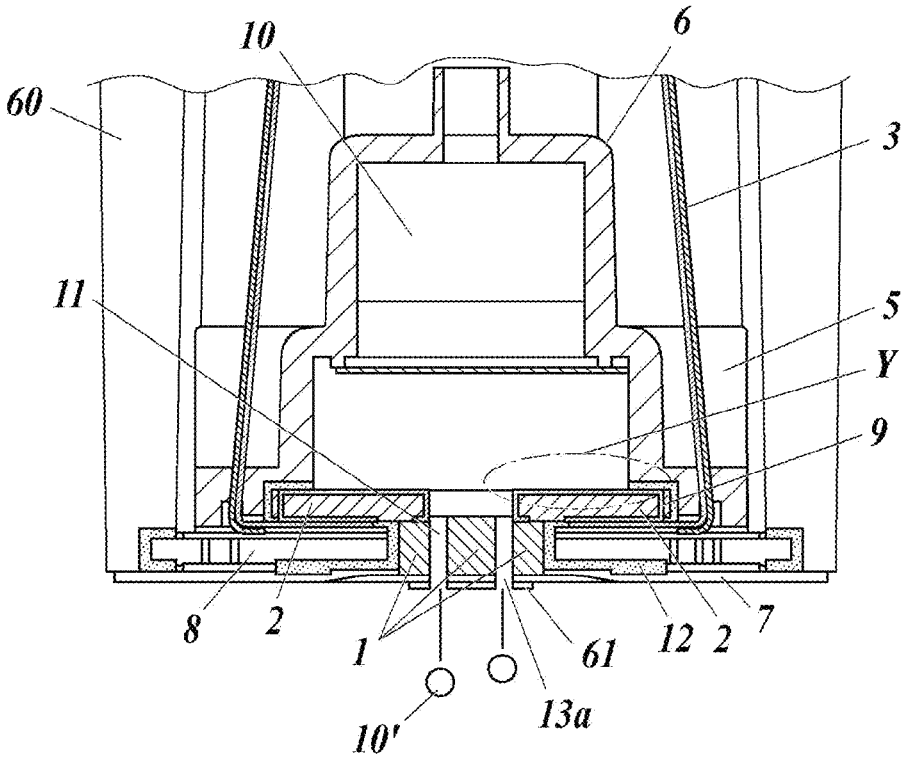
FIG. 3 is a sectional view taken along line IV-IV of the inkjet head shown in FIG. 1A.

FIG. 3 is a schematic diagram of a cross section of the inkjet head (100) taken along IV-IV, and is an example showing an internal structure of the inkjet head.

Inside the casing (60), a manifold (5) having the common ink chamber (6), the wiring board (2), and the head chip (1) are arranged. The metal wiring(s) (9) on the wiring board (2) is electrically connected to the piezoelectric element in the head chip and the flexible printed board (3).

The head chip (1) has a drive wall formed of a piezoelectric element such as PZT (lead zirconium titanate). When an electric (driving potential) signal related to ink ejection reaches the piezoelectric element, the driving wall undergoes shear deformation, and pressure is applied to the ink (10) in the ink channel (11). Then, ink droplets (10') are ejected from the nozzles (13) formed on the nozzle plate (61). The head chip (1), the wiring board (2) and the sealing plate (8) are bonded together using an adhesive (12).

Figure 4:
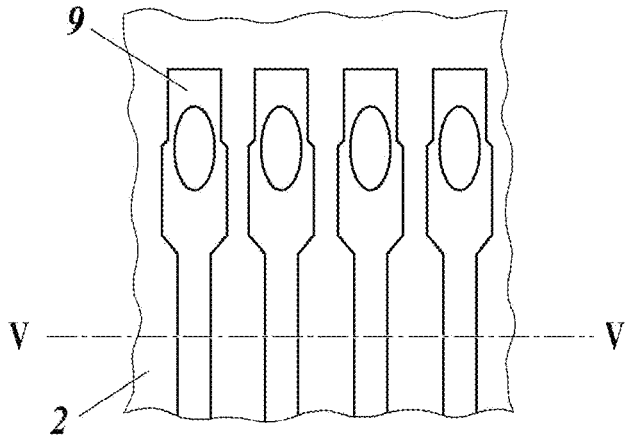
FIG. 4 is a schematic diagram of a metal wiring.

FIG. 4 is an enlarged view of a region Y surrounded by a dotted line in FIG. 3, and is a schematic view showing metal wiring (9) formed on the wiring board (2). Electricity is supplied to the plurality of piezoelectric elements from the respective plurality of metal wirings (9). As shown in FIG. 3, the metal wirings (9) are formed in the ink flow path or the ink tank in order to increase its density. Therefore, in order to protect the metal wiring from contact with ink, it is necessary to provide an organic protective layer having high insulation and high chemical resistance on the metal wiring.

[1.3] Configuration of Metal Wiring, Base Layer, and Organic Protective Layer

Figure 5A:
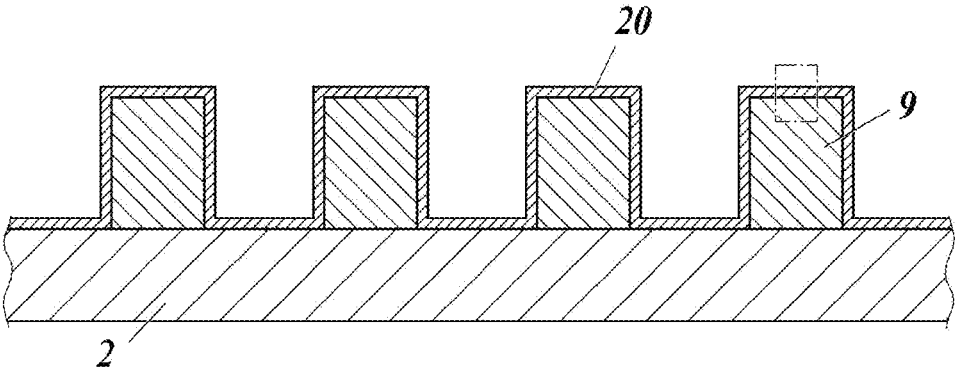
FIG. 5A is a cross-sectional view taken along line V-V of the metal wiring shown in FIG. 4.
Figure 5B:
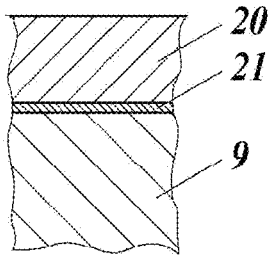
FIG. 5B is a cross-sectional view showing a known configuration example of metal wiring and an organic protective layer.
Figure 5C:
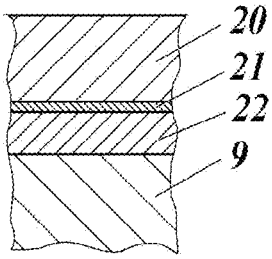
FIG. 5C is a cross-sectional view showing a configuration of a metal wiring, a base layer, and an organic protective layer according to the present invention.

FIG. 5A is a sectional view of FIG. 4 showing the metal wiring taken along V-V. FIG. 5B and FIG. 5C are enlarged views of a region surrounded by a dotted line in FIG. 5A.

In FIG. 5A, electrodes that are metal wirings (9) are formed on the wiring board (2), and the wiring board (2) and metal wirings (9) are entirely covered with an organic protective layer (20). The used metal wirings are gold electrodes or the like, and the organic protective layer contains an organic material such as polyparaxylylene or its derivative.

FIG. 5B is a cross-sectional view showing a known configuration example.

The metal wiring (9) is formed on the wiring board (2), an adhesive layer (21) containing a silane coupling agent is formed on the wiring board (2) and the metal wiring (9), and the organic protective layer (20) covers them as a whole. The adhesive layer (21) containing the silane coupling agent is formed so as to improve the adhesion of the wiring board (2), the metal wiring (9), and the organic protective layer (20). Alternatively, the organic protective layer (20) may contain the silane coupling agent. In this case, the silane coupling agent is preferably present at the interfaces between the wiring board (2) and the organic protective layer (20) and between the metal wiring (9) and the organic protective layer (20).

There is also an attempt to improve the adhesion between the metal wiring and the organic protective layer by providing an inorganic insulating layer containing silicon oxide or silicon nitride instead of the adhesive layer (21) containing the silane coupling agent. However, because metal wiring has poor adhesion to silicon oxide or silicon nitride, neither of them has the adhesion level expected as a protective layer.

FIG. 5C is a cross-sectional view showing a configuration of the metal wiring, base layer, and organic protective layer according to the present invention.

A metal wiring (9) is formed on a wiring board (2), a base layer (22) containing a metal oxide or metal nitride and a silicon oxide or silicon nitride according to the present invention is formed on the wiring board (2) and the metal wiring (9), an adhesive layer (21) containing a silane coupling agent is further formed thereon, and the organic protective layer (20) covers them as a whole. The adhesive layer (21) containing the silane coupling agent is formed so as to improve the adhesion of the organic protective layer (20) and the base layer (22). Alternatively, the adhesive layer may not be formed, but the organic protective layer (20) may contain the silane coupling agent. In this case, the silane coupling agent is preferably present at the interface between the base layer and the organic protective layer. That is, the organic protective layer preferably contains the silane coupling agent, or the adhesive layer containing silane coupling agent is preferably provided as an adjacent layer between the base layer and the organic protective layer.

An inkjet head according to the present invention includes a metal wiring (9), a base layer (22), and an organic protective layer (20) on the wiring board (2) arranged in this order, and the base layer has an interface that is in contact with the metal wiring and that includes at least one of a metal oxide and a metal nitride, and the base layer has an interface that is in contact with the organic protective layer and that includes at least one of a silicon oxide and a silicon nitride.

The configuration of the base layer according to the present invention is preferably those shown in (1) to (3) below, but is not limited to the following embodiments.

Figure 6A:
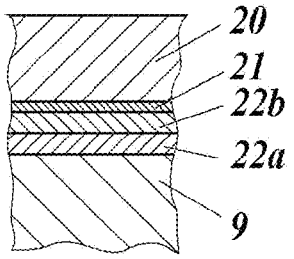
FIG. 6A is a cross-sectional view showing a configuration of a metal wiring, a base layer, and an organic protective layer when the base layer has a two-layer structure.
Figure 6B:
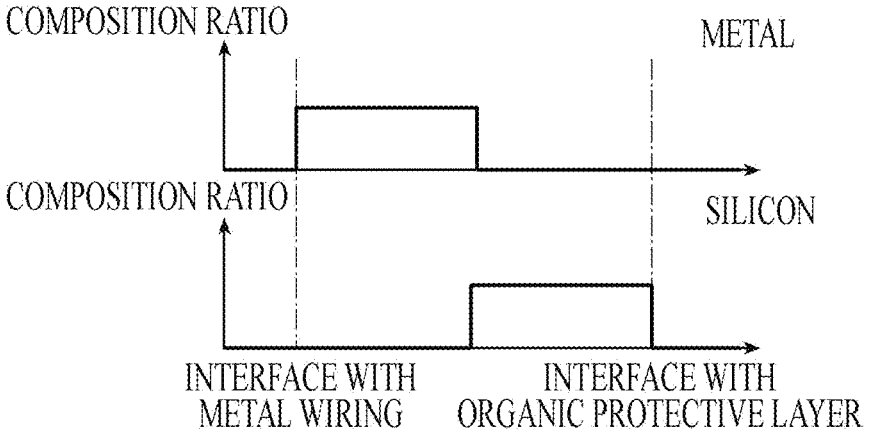
FIG. 6B is a schematic diagram showing composition ratios of metal and silicon in a thickness direction of the base layer when the base layer has a two-layer structure.

(1) Embodiment in which the Base Layer has a Laminated Structure of Two or More Layers (See FIG. 6A and FIG. 6B)

In this embodiment, the base layer has a laminated structure including two or more layers, one is in contact with the metal wiring and includes at least one of a metal oxide and a metal nitride, and another is in contact with the organic protective layer and includes at least one of a silicon oxide and a silicon nitride.

The layer thickness of the base layer as a total layer thickness is preferably in the range of 0.1 nm to 10 μm. The total layer thickness is more preferably in the range of 10 nm to 5 μm, and particularly preferably in the range of 50 nm to 1 μm. When the total layer thickness is 10 μm or less, failure due to layer stress of the base layer including peeling of layer(s) from the wiring board or the metal wiring, warping of the board, and the like does not occur. The thickness of each layer can be adjusted appropriately as long as the total layer thickness is within the range.

The base layer preferably has a two-layer structure as a simple configuration to obtain the effect of the present invention.

FIG. 6A is a cross-sectional view showing a configuration of the metal wiring, base layer, and organic protective layer when the base layer has a two-layer structure.

There are a base layer (22*a*) that is adjacent to the metal wiring (9) and contains at least a metal oxide or metal nitride and a base layer (22*b*) that is adjacent to the organic protective layer (20) and contains at least a silicon oxide or silicon nitride.

In the present embodiment, the base layer (22*a*) containing a metal oxide or metal nitride preferably contains the metal oxide or metal nitride as a main component, and the base layer (22*b*) containing a silicon oxide or silicon nitride preferably contains the silicon oxide or silicon nitride as a main component. The metal oxide or metal nitride and the silicon oxide or silicon nitride is referred to as the "main components" when they are contained in the base layer (when the base layer consists of multiple layers, in a corresponding layer in the base layer) in an amount of 60% by mass or more, preferably 80% by mass or more, more preferably 90% by mass or more, and may be contained in an amount of 100% by mass.

The base layer (22*a*) containing a metal oxide or metal nitride may contain a silicon oxide or silicon nitride as long as the effect of the present invention is not hindered. Similarly, the base layer (22*b*) containing a silicon oxide or silicon nitride may contain a metal oxide or metal nitride. When the materials are mixed as described above, the balance of metal and silicon (the composition ratio) is not particularly limited.

FIG. 6B is a schematic diagram showing the composition ratios of metal atoms and silicon atoms in the thickness direction of the base layer when the base layer has a two-layer structure.

In the schematic view of FIG. 6B, the base layer (22*a*) containing a metal oxide or nitride contains only a metal oxide or metal nitride, and the base layer (22*b*) containing a silicon oxide or silicon nitride contains only a silicon oxide or silicon nitride. In FIG. 6B, the layer thickness of the base layer (the layer thickness direction from the interface between the metal wiring and the base layer to the interface between the base layer and the organic protective layer) is shown along the horizontal axis, and the composition ratio of metal or silicon is shown separately in the vertical direction.

The composition ratio of the metal in the base layer (22*b*) is appropriately determined from the viewpoint of obtaining the effect of the present invention, and is preferably in the range of 1 to 50 at % at the interface with the metal wiring. More preferably, it is 15 to 35 at %.

The composition ratio of the silicon in the base layer (22*a*) is appropriately determined from the viewpoint of obtaining the effect of the present invention, and is preferably in the range of 1 to 50 at % at the interface with the organic protective layer. More preferably, it is 25 to 45 at %.

The method for measuring the composition ratio of the metal and the silicon in the base layer according to the present invention is not particularly limited. In the present invention, for example, the measurement may be made by quantitative analysis of a cut portion of the base layer after cutting a region of 10 nm from the surface with a knife, etc., by quantifying the mass of the compound in the thickness direction of the base layer using a method of scanning with infrared spectroscopy (IR) or atomic absorption, or, even for an ultra-thin layer of 10 nm or less, by quantifying using an XPS (X-ray Photoelectron Spectroscopy) analysis method. Among them, the XPS analysis method is a preferable method from the viewpoint of being able to perform elemental analysis even with an ultrathin layer and that the composition ratio in the layer thickness direction of the entire base layer can be measured by depth profile measurement described below.

<XPS Analysis Method>

The XPS analysis method here is a method of analyzing the constituent elements of a sample and their electronic states by irradiating the sample with X-rays and measuring the energy of the generated photoelectrons.

A distribution curve of element concentration in the thickness direction of the base layer according to the present invention (hereinafter, referred to as "depth profile") can be obtained by measuring element concentration of metal oxide or nitride, element concentration of silicon oxide or nitride, element concentration of oxygen (O), nitrogen (N), or carbon (C), etc. by sequentially performing surface composition analysis as the inside of the base layer is exposed from its surface. In the analysis, X-ray photoelectron spectroscopy measurement and rare gas ion sputtering such as argon (Ar) are used in combination.

In the distribution curve obtained by such XPS depth profile measurement can be made, for example, the vertical axis represents the atomic concentration ratio of each element (unit: at %), and the horizontal axis represents the etching time (sputtering time). In such a distribution curve of an element where the horizontal axis represents the etching time, the "distance from the surface of the base layer in the thickness direction of the base layer" may be the distance from the surface of the base layer calculated from the relationship between the etching rate and the etching time used when measuring the XPS depth profile, because the etching time roughly correlates with the distance from the surface of the base layer in the layer thickness direction of the base layer. The sputtering method used for such XPS depth profile measurement is preferably a rare gas ion sputtering method using argon (Ar) as an etching ion species, and the etching rate is preferably 0.05 nm/sec ($SiO_2$ thermal oxide layer conversion value).

An example of specific conditions of XPS analysis applicable to the composition analysis of the base layer according to the present invention is shown below.

Analyzer: QUANTERA SXM manufactured by ULVAC-PHI

X-ray source: Monochromatic Al-Kα

Sputtering ion: Ar (2 keV)

Depth profile: The depth profile in the depth direction is obtained by repeating measurement at a predetermined thickness interval based on the $SiO_2$ converted sputter thickness. The thickness interval was 1 nm (data is obtained every 1 nm in the depth direction).

Quantification: The background is determined by the Shirley method, and the peak area was quantified using the relative sensitivity coefficient method. Data is processed using MultiPak manufactured by ULVAC-PHI. Elements in metal oxides or nitrides and silicon oxides or nitrides (for example, titanium (Ti), silicon (Si), oxygen (O), nitrogen (N)) are analyzed.

When the base layer is a monolayer of the metal oxide or nitride and the silicon oxide or nitride according to the obtained data, an average composition ratio of the metal and silicon from the surface to 0.1 nm in the thickness direction of the base layer is calculated. When it is not form a monolayer and has a thickness of less than 10 nm, an average composition ratio of the metal and silicon from the surface (interface) to the thickness is calculated. When it is not form a monolayer and has a thickness of 10 nm or more, an average composition ratio of the metal and silicon from the surface to 10 nm in the thickness direction is calculated. The average composition ratio is an average of the values measured from 10 random points in the sample.

The method of controlling the composition ratio of the metal and silicon is not particularly limited. For example, in layer formation using a vapor deposition method or a plasma CVD method (Chemical Vapor Deposition) using an elementary substance, oxide, or nitride of metal, and an elementary substance or oxide of silicon, the controlling method include selection of materials, selection of vapor deposition conditions (applied power, discharge current, discharge voltage, time, etc.), and the like.

Figure 7A:
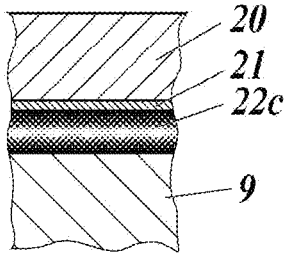
FIG. 7A is a cross-sectional view showing a configuration of a metal wiring, a base layer, and an organic protective layer when composition ratios of metal and silicon have gradients in a thickness direction of the base layer.
Figure 7B:
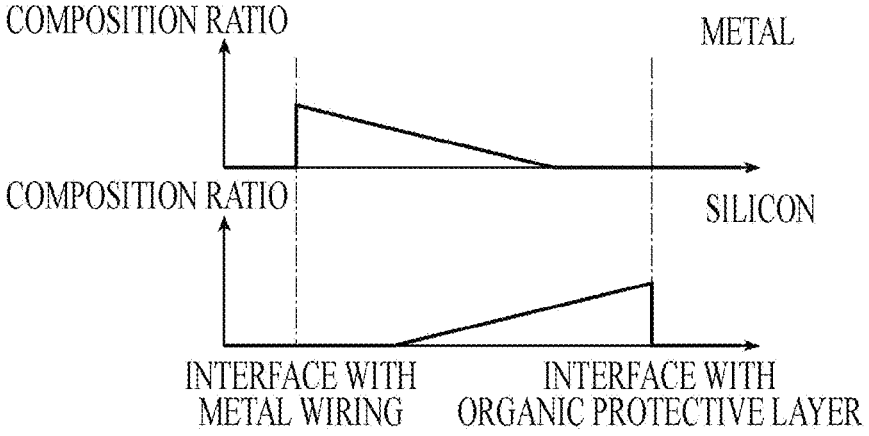
FIG. 7B is a schematic diagram showing composition ratios when composition ratios of metal and silicon have gradients in a thickness direction of the base layer.

(2) Embodiment in which Gradients in Composition Ratios of Metal and Silicon in Base Layer are Observed in Layer Thickness Direction (See FIG. 7A and FIG. 7B)

This embodiment is characterized in that the base layer includes a mixture of the metal oxide or metal nitride and the silicon oxide or silicon nitride, and at least one of a composition ratio of the metal and a composition ratio of the silicon has a gradient in a layer thickness direction.

"The composition ratio has a gradient" means that there is a concentration gradient in the composition ratio of the metal and the silicon along the thickness direction of the base layer. For example, the metal composition distribution will be described as an example.

As the simplest example of the preferred embodiment, when the base layer according to the present invention is equally cut into two portions in a plane perpendicular to the thickness direction (a plane parallel to the plane of the base layer), the composition ratio of the metal present in a portion including the surface is lower or higher than the composition ratio of the metal present in the other portion.

As a generalized example of the above, which is also a preferred embodiment, when the base layer according to the present invention is equally cut into k portions in a plane(s) perpendicular to the thickness direction (a plane(s) parallel to the plane of the base layer), the composition ratio of the metal present in each portion gradually decreases or increases from the fragment containing the surface toward the other portion(s). In the embodiment, the case where k=2 has been described above, but k is preferably 3 or more, more preferably 5 or more, further preferably 10 or more, and particularly preferably 20 or more. The gradient of decrease or increase may be continuous or discontinuous, but is preferably continuous. Furthermore, decreasing or increasing gradients may be repeated within a layer.

FIG. 7A is a cross-sectional view showing a configuration of the metal wiring, the base layer, and the organic protective layer when the composition ratio of metal and silicon has a gradient in the thickness direction of the base layer.

In this configuration example, the base layer (22*c*) adjacent to the metal wiring (9) and including a mixture of the metal oxide or metal nitride and the silicon oxide or silicon nitride, the adhesive layer (21) including a silane coupling agent, and the organic protective layer (20) are provided.

In the base layer, the composition ratio of the metal and the composition ratio of the silicon each have a gradient. Therefore, the interface in contact with the metal wiring mainly contains the metal, and conversely, the interface in contact with the organic protective layer mainly contains the silicon. This can be realized because each composition ratio has a gradient within a single layer. Therefore, the number of layers can be reduced, which can improve productivity.

FIG. 7B is a schematic diagram showing the composition ratios of metal and silicon having a gradient in the thickness direction of the base layer.

The composition ratio of the metal is high at the interface in contact with the metal wiring and gradually decreases in the layer thickness direction. On the contrary, the composition ratio of silicon is higher toward the interface in contact with the organic protective layer. This can be designed in the single layer, and the adhesion between the base layer and the metal wiring and the board, and the adhesion between the base layer and the organic protective layer are improved. It is possible to strengthen the overall adhesion between the metal wiring and the board and the organic protective layer. The slope of the gradient is not particularly limited. In this configuration example, the composition ratio of either metal or silicon may not have a gradient.

In this configuration, the composition ratio of the metal in the base layer (22*c*) is appropriately determined from the viewpoint of obtaining the effect of the present invention. However, in the interface with the metal wiring, the content of the metal is preferably in the range of 1 to 50 at %, more preferably 15 to 35 at %.

The composition ratio of the silicon in the base layer (22*c*) is appropriately determined from the viewpoint of obtaining the effect of the present invention. However, in the interface with the organic protective layer, the content of the silicon is preferably in the range of 1 to 50 at %, more preferably 25 to 45 at %.

The method for controlling the composition ratio of the metal and silicon is not particularly limited. For example, in layer formation using a vapor deposition method or a plasma CVD method using an elementary substance, oxide, or nitride of metal, and an elementary substance, oxide, or nitride of silicon, the controlling method may include change in introduction ratio of two kinds of materials into the reaction chamber using the co-evaporation method, selection of vapor deposition conditions (applied power, discharge current, discharge voltage, time, etc.), and the like.

Figure 8A:
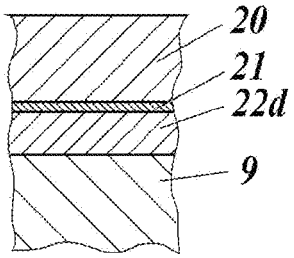
FIG. 8A is a cross-sectional view showing a configuration of a metal wiring, a base layer, and an organic protective layer when metal and silicon are mixed and their composition ratios are uniform in a thickness direction of the base layer.
Figure 8B:
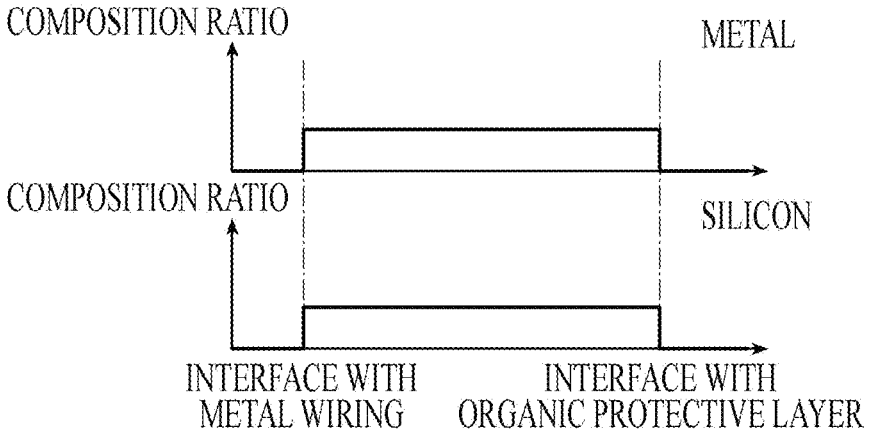
FIG. 8B is a schematic diagram showing composition ratios when metal and silicon are mixed and their composition ratios are uniform in a thickness direction of the base layer.

(3) Embodiment in which Base Layer Contains an Oxide or a Nitride in which a Metal and Silicon are Mixed (See FIG. 8A and FIG. 8B).

In this configuration, the base layer includes a mixture of the metal oxide or metal nitride and the silicon oxide or silicon nitride, and both a composition ratio of the metal and a composition ratio of the silicon are uniform in a layer thickness direction. For example, the base layer according to the present invention can be more easily formed by using a metal silicate in which a metal and silicon are mixed as a raw material. Thereby, the adhesion between the metal wiring and the organic protective layer and the ink durability can be improved.

FIG. 8A is a cross-sectional view showing a configuration of the metal wiring, the base layer, and the organic protective layer when metal and silicon are mixed and have a uniform composition ratio in the thickness direction of the base layer.

In this configuration, the base layer (22*d*) adjacent to the metal wiring (9) and including a mixture of the metal oxide or metal nitride and the silicon oxide or silicon nitride, the adhesive layer (21) including a silane coupling agent, and the organic protective layer (20) are provided.

In this configuration, the base layer preferably includes a mixture of the metal oxide or metal nitride and the silicon oxide or silicon nitride, and both a composition ratio of the metal and a composition ratio of the silicon are uniform in the layer thickness direction. Since the composition ratio is uniform, the base layer according to the present invention can be formed easily without performing a complicated control of conditions using a single raw material such as metal silicate. The adhesion between the metal wiring and the organic protective layer and the ink durability can be improved.

The term "uniform" means that the metal oxide or nitride and silicon oxide or nitride according to the present invention are present in a mixed state in the base layer, and the respective composition ratios are distributed within the fluctuation range (variation) of ±10 at % over the entire base layer.

FIG. 8B is a schematic diagram showing the composition ratio in the thickness direction of the base layer when the metal and silicon are mixed and have uniform composition ratios.

In the base layer (22*d*) containing a mixture of the metal oxide or metal nitride and the silicon oxide or silicon nitride, the metal composition ratio and the silicon composition ratio take constant values from the interface of the metal wiring to the interface of the organic protective layer.

[2] Material and Forming Method of Board, Metal Wiring, Base Layer, and Organic Protective Layer According to the Present Invention

[2.1] Regarding Board

The wiring board (2) used in the present invention is preferably a glass board.

Examples of the glass include inorganic glass and organic glass (resin glazing). Examples of the inorganic glass include float plate glass, heat ray absorbing plate glass, polished plate glass, template glass, plate glass with net, plate glass with wire, and colored glass such as green glass. The organic glass is synthetic resin glass that substitutes for the inorganic glass. Examples of the organic glass (resin glazing) include a polycarbonate plate and a poly(meth) acrylic resin plate. Examples of the poly(meth)acrylic resin plate include a polymethyl(meth)acrylate plate. The board of the present invention is preferably inorganic glass from the viewpoint of safety when it is damaged by an impact from the outside.

In the inkjet head (100) of the present embodiment, an ink channel (11) that is an ink flow path is formed by a board for a piezoelectric element and members forming other walls (typically, an ink channel lid formed by adhering flat plates made of glass, ceramic, metal, or plastic).

As the board for the piezoelectric element, for example, a board such as $Pb(Zr, Ti)O_3$ (lead zirconate titanate, hereinafter referred to as PZT), $BaTiO_3$, $PbTiO_3$, or the like can be used. Among them, a PZT board, which contains PZT and is a piezoelectric ceramic board having piezoelectric properties, is preferable because it is excellent in piezoelectric properties such as a piezoelectric constant and its high frequency response.

As the members forming other walls, various materials described above can be used as long as it has high mechanical strength and ink durability, a ceramic board is preferably used. Furthermore, considering that it is used by being joined to a piezoelectric ceramic board such as a deformed PZT board, the non-piezoelectric ceramic board is preferably used. This is preferable because the side wall of the piezoelectric ceramic that is displaced can be firmly supported, and since the ceramic board itself is less deformed, efficient driving with lower voltage can be performed.

A specific board contains, as a main component, at least one of silicon, aluminum oxide (alumina), magnesium oxide, zirconium oxide, aluminum nitride, silicon nitride, silicon carbide, and quartz. In particular, a ceramic board containing aluminum oxide or zirconium oxide as a main component is preferable because it has excellent board characteristics even when the plate thickness is thin, so as to be less damaged by sleds and stress due to heat generated during driving and the expansion of the board in response to change in the environmental temperature. A board containing aluminum oxide as a main component is particularly preferable because it is inexpensive and highly insulating.

It is particularly preferable to use the PZT board as the side wall or the side and bottom walls and the non-piezoelectric ceramic board as the bottom plate or the top plate because a high-performance share mode piezo inkjet head can be manufactured at low cost. Furthermore, it is more preferable to use an aluminum oxide board as the non-piezoelectric ceramic board because the inkjet head can be manufactured at a lower cost.

[2.2] Material and Forming Method of Metal Wiring

The metal of the metal wiring according to the present invention is preferably any one of gold, platinum, copper, silver, palladium, tantalum, titanium or nickel. Among them, gold, platinum or copper is preferable from the viewpoint of electrical conductivity, stability and corrosion resistance. The metal wiring is preferably an electrode in which the metal is formed into a layer having a thickness of usually about 0.5 to 5.0 μm by, for example, a vapor deposition method, a sputtering method, a plating method, or the like.

The nozzle plate (61) is preferably made of, for example, plastics such as polyalkylene, ethylene terephthalate, polyimide, polyetherimide, polyetherketone, polyethersulfone, polycarbonate, and cellulose acetate, stainless steel, nickel, silicon, or the like.

An electrode (not shown) is drawn out to a surface side where an ink channel (11) and a head chip (1) having a driving wall composed of a piezoelectric element are bonded to the board. Before the step of forming the organic protective layer, the metal wiring (9) is bonded to the electrode with a conductive adhesive (not shown). In this bonding step, it is preferable to perform a pretreatment such as cleaning or polishing before applying the adhesive, depending on the condition of each bonding surface. Pretreatment of the surfaces to be bonded enables good bonding.

[2.3] Material and Formation Method of Base Layer

[2.3.1] Metal Oxide or Nitride

The metal oxide or nitride contained in the base layer according to the present invention is preferably oxide or nitride of titanium, zirconium, tantalum, chromium, nickel, or aluminum. Among them, titanium is preferable from the viewpoint of adhesion, and titanium oxide ($TiO_2$) is particularly preferable.

[2.3.2] Silicon Oxide or Nitride

The silicon oxide or nitride contained in the base layer according to the present invention is preferably silicon dioxide ($SiO_2$), which is an oxide of silicon, from the viewpoint of siloxane bond. Silicon dioxide is classified into natural products, synthetic products, crystalline products, and amorphous products. When making a material in which metallic silicon, silicon monoxide, and silicon dioxide are mixed, the silicon dioxide is preferably crystalline silicon dioxide having a shape as close as possible to the usually crystalline metallic silicon and silicon monoxide, so that they melt similarly to each other in evaporation. Silicon dioxide may be partially mixed with silicon nitride oxide, silicon carbonitride, and the like as long as the effect of the present invention is not impaired.

[2.3.3] Metal Silicate

In the embodiment (3), metal silicate is preferably used. In this case, a metal silicate containing silicon in an oxide of a metal containing at least one kind of metal element that is chemically stable in a high oxidation state, such as tantalum, hafnium, niobium, titanium, and zirconium, is preferably used. Examples of such metal silicates include zirconium silicate ($ZrSi_xO_y$), hafnium silicate ($HfSi_xO_y$), lanthanum silicate ($LaSi_xO_y$), yttrium silicate ($YSi_xO_y$), titanium silicate ($TiSi_xO_y$), and tantalum silicate ($TaSi_xO_y$). Among these, titanium silicate ($TiSi_xO_y$) is preferable.

[2.3.4] Method for Forming Base Layer

The base layer can be formed, for example, by the following method so that the composition ratio of the metal in the base layer and the composition ratio of silicon in the base layer have desired values: a dry process such as vacuum deposition method, sputtering method, reactive sputtering method, molecular beam epitaxy method, cluster ion beam method, ion plating method, plasma polymerization method, atmospheric pressure plasma polymerization method, plasma CVD method, laser CVD method, thermal CVD method; a coating method such as spin coating, casting, and clavier coating; and a wet process such as printing method including inkjet printing method.

Among them, forming by a dry process such as a vacuum deposition method, a sputtering method or an ion plating method is a preferable forming method from the viewpoint of precisely controlling the metal composition ratio and the silicon composition ratio.

Examples of the vacuum vapor deposition method include resistance heating vapor deposition, high frequency induction heating vapor deposition, electron beam vapor deposition, ion beam vapor deposition, and plasma assisted vapor deposition. The vacuum evaporation method is a method of forming a layer by evaporating or sublimating a material to be formed into a layer in a vacuum, and vapor of the material reaches a board (a target object or a place where the layer is formed) and is deposited. Because the evaporation material and board are not electrically applied and the vaporized material reaches the board as it is, it is possible to form a layer of high purity with little damage of the board.

Examples of the sputtering method include a magnetron cathode sputtering, a flat plate magnetron sputtering, a two-pole AC flat plate magnetron sputtering, a two-pole AC rotating magnetron sputtering, and a reactive sputtering method. In the sputtering method, particles having high energy due to plasma or the like are collided with a material (target), the material components are knocked out by the impact, and the particles are deposited on a board to form a layer. Since the material itself is knocked out, almost all the alloy components can be deposited on the board.

Examples of the ion plating method include a DC ion plating method and an RF ion plating method. The ion plating method has almost the same principle as the vapor deposition method, except that vaporized particles pass through the plasma to have a positive charge, and the evaporated particles are attracted and deposited on the board to which a negative charge is applied to form a layer. As a result, it is possible to form a layer having stronger adhesion than the vapor deposition method.

In the present invention, it is preferable to include a cleaning step for removing a residue of a material for metal wiring as a pretreatment at the time of forming the base layer, a step of either degreasing cleaning, plasma treatment, or reverse sputtering process.

The degreasing cleaning can remove the residue of the material for metal wiring and improve the adhesion between the metal wiring and the organic protective layer containing parylene.

As a cleaning liquid for removing the residue of the material for metal wiring on the surface of the metal wiring, it is preferable to use a cleaning liquid that has fast drying property and low reactivity with the metal wiring. As such a cleaning liquid, for example, an alcohol-based cleaning liquid such as isopropyl alcohol is preferably used. As other cleaning liquids, hydrocarbon-based cleaning liquids and fluorine-based cleaning liquids can be preferably used.

The plasma treatment can remove the residue of the material for metal wiring by, for example, supplying electric power for plasma generation to the metal wiring with a pressure gradient type plasma gun in which a predetermined flow rate of argon (Ar) gas is introduced, and then converging the plasma flow for irradiation.

In the reverse sputtering process, in order to remove the residue of the material for metal wiring, a proper argon (Ar) ion beam irradiation is performed to clean each bonding surface. For example, as the reverse sputtering process, a sputtering process is performed on the board material using oxygen ($O_2$) gas, argon (Ar) gas, or a mixed gas thereof. By performing the reverse sputtering process, removing effects of contaminants on the surface or surface activation effects of the board material can be obtained, and the adhesion between the base material and the base layer can be enhanced.

That is, in the reverse sputtering process, a certain object is irradiated with some kind of energy ray to cause sputtering, and as a result, the irradiated portion is physically scraped.

The reverse sputtering process as an example for performing cleaning can be performed as follows. The metal wiring is irradiated with an inert gas such as argon (Ar) with an accelerating voltage of 0.1 to 10 kV, preferably 0.5 to 5 kV, and a current value of 10 to 1000 mA, preferably 100 to 500 mA, for 1 to 30 minutes, preferably 1 to 5 minutes.

[2.4] Material and Forming Method of Organic Protective Layer

[2.4.1] Organic Protective Layer Material

The organic protective layer according to the present invention preferably contains polyparaxylylene or a derivative thereof, polyimide, or polyurea so as to suppress corrosion of metal wiring and generation of electrical leak.

(Polyparaxylylene or Derivative Thereof)

The organic protective layer preferably forms a so-called parylene layer using polyparaxylylene or its derivative as a main component (hereinafter, the organic protective layer using polyparaxylylene is also referred to as a parylene layer). The parylene layer is a resin coating layer made of paraxylylene resin or a derivative resin thereof, and can be formed by, for example, a CVD method (Chemical Vapor Deposition) using a solid diparaxylylene dimer or a derivative thereof as a vapor deposition source. That is, the paraxylylene radical generated by vaporization and thermal decomposition of diparaxylylene dimer is adsorbed on the surface of the flow path member or the metal layer and subjected to a polymerization reaction to form a coating layer.

There are parylene layers with various properties. Depending on the required property and the like, the desired parylene layer to be applied may be various parylene layers, a parylene layer having a multilayer structure in which a plurality of these parylene films are laminated, or the like. Examples thereof include polyparaxylylene, polymonochloroparaxylylene, polydichloroparaxylyl ene, polytetrachloroparaxylylene, polyfluoroparaxylylene, polydimethylparaxylylene and polydiethylparaxylylene. The polyparaxylylene is preferably used.

The layer thickness of the parylene layer is preferably in the range of 1 to 20 μm from the viewpoint of obtaining excellent insulating properties and ink durability effects.

Polyparaxylylene is a crystalline polymer having a molecular weight of up to 500,000. The raw material paraxylylene dimer is sublimated and thermally decomposed to generate paraxylylene radicals. The paraxylylene radical adheres to the wiring board (2), the metal wiring (9), and the base layer (22), at the same time polymerized to generate polyparaxylylene, and forms a protective layer.

Examples of polyparaxylylene include Parylene N (trade name, manufactured by Japan Parylene Co., Ltd.).

Examples of polyparaxylylene derivative include Parylene C (trade name of Nippon Parylene Co., Ltd.) in which one chlorine atom is substituted on the benzene ring, Parylene D (trade name of Nippon Parylene Co., Ltd.) in which chlorine atoms are substituted at the 2- and 5-positions of the benzene ring, and Parylene HT (trade name of Japan Parylene Co., Ltd.) in which the hydrogen atom of the methylene group connecting the benzene rings is replaced with a fluorine atom.

Among these, as the polyparaxylylene and the derivative of polyparaxylylene of the present embodiment, parylene N or parylene C is preferably used from the viewpoint of obtaining the excellent insulating property and ink durability effect when having the above-mentioned layer thickness.

(Polyimide)

The polyimide used in the present invention is preferably obtained via a polyamic acid (precursor of polyimide) by the reaction of a generally known aromatic polycarboxylic acid anhydride or its derivative with an aromatic diamine. Since polyimide has a rigid main chain structure, it is insoluble in a solvent and does not melt. Therefore, it is preferable that a polyimide precursor (polyamic acid or polyamic acid) soluble in an organic solvent is first synthesized from an acid anhydride and an aromatic diamine, and molding processing is also performed by various methods at this stage. After that, the polyamic acid is heated or dehydrated by a chemical method to cyclize (imidize) to obtain a polyimide. An outline of the reaction is shown in Reaction Formula (I).

Reaction Formula (I)

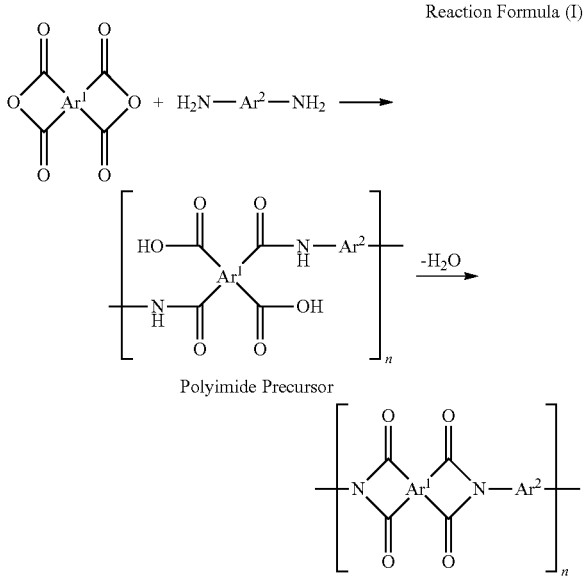

(in the formula, $Ar^1$ represents a tetravalent aromatic residue containing at least one carbon 6-membered ring, and $Ar^2$ represents a divalent aromatic residue containing at least one carbon 6-membered ring.)

Specific examples of the aromatic polyvalent carboxylic acid anhydride include, for example, ethylene tetracarboxylic dianhydride, cyclopentane tetracarboxylic dianhydride, pyromellitic dianhydride, 3,3',4,4'-benzophenone tetracarboxylic dianhydride, 2,2',3,3'-Benzophenonetetracarboxylic dianhydride, 3,3',4,4'-biphenyltetracarboxylic dianhydride, 2',3,3'-biphenyltetracarboxylic dianhydride, 2,2-bis(2,3-dicarboxyphenyl)propane dianhydride, bis(3,4-dicarboxyphenyl)ether dianhydride, bis(3,4-dicarboxyphenyl)sulfone dianhydride, 1,1-bis (2,3-Dicarboxyphenyl)ethane dianhydride, bis(2,3-dicarboxyphenyl)methane dianhydride, bis(3,4-dicarboxyphenyl)methane dianhydride, 2,2-bis(3,4-dicarboxyphenyl)-1,1,1,3,3,3-hexafluoropropane dianhydride, 2,3,6,7-naphthalenetetracarboxylic dianhydride, 1,4,5,5 8-naphthalenetetracarboxylic dianhydride, 1,2,5,6-naphthalenetetracarboxylic dianhydride, 1,2,3,4-benzenetetracarboxylic dianhydride, 3,4,9,10-Perylene tetracarboxylic dianhydride, 2,3,6,7-anthracene tetracarboxylic dianhydride, 1,2,7,8-phenanthrene tetracarboxylic dianhydride, etc. These may be used alone or in combination of two or more.

Next, specific examples of aromatic diamines to be reacted with aromatic polycarboxylic acid anhydrides include, for example, m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, bis(3-aminophenyl)sulfide, (3-aminophenyl)(4-aminophenyl) sulfide, bis(4-aminophenyl)sulfide, bis(3-aminophenyl) sulfide, (3-aminophenyl)(4-aminophenyl) sulfoxide, bis(3-aminophenyl) sulfone, (3-aminophenyl)(4-aminophenyl) sulfone, bis(4-aminophenyl) sulfone, 3,3'-diaminobenzophenone, 3,4'-diaminobenzophenone, 4,4'-diaminobenzophenone, 3,3'-diaminodiphenylmethane, 3,4'-diaminodiphenylmethane, 4,4'-diaminodiphenylmethane, bis[4-(3-aminophenoxy)phenyl]methane, bis[4-(4-aminophenoxy) phenyl]methane, 1,1-bis[4-(3-aminophenoxy)phenyl] ethane, 1,1-bis[4-(4-aminophenoxy)phenyl]-ethane, 1,2-bis [4-(3-aminophenoxy)phenyl]ethane, 1,2-bis[4-(4-aminophenoxy)phenyl]ethane, 2,2-bis[4-(3-aminophenoxy) phenyl]propane, 2,2-bis[4-(4-aminophenoxy)phenyl] propane, 2,2-bis[4-(3-aminophenoxy)phenyl]butane, 2,2-bis [3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy) benzene, 1,3-bis(4-aminophenoxy)benzene, 1,4-bis(3-aminophenoxy)benzene, 1,4-bis(4-aminophenoxy)benzene, 4,4'-bis(3-aminophenoxy)biphenyl, 4,4'-bis(4-aminophenoxy)biphenyl, bis[4-(3-aminophenoxy)phenyl]ketone, bis [4-(4-aminophenoxy)phenyl]ketone, bis[4-(3-aminophenoxy)phenyl]sulfide, bis[4-(4-amido)nophenoxy)phenyl] sulfide, bis[4-(3-aminophenoxy)phenyl]sulfoxide, bis[4-(4-aminophenoxy)phenyl]sulfoxide, bis[4-(3-aminophenoxy) phenyl]sulfone, bis[4-(4-aminophenoxy)phenyl]sulfone, bis [4-(3-aminophenoxy)phenyl]ether, bis[4-(4-aminophenoxy) phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenyl sulfone, bis [4-{4-(4-aminophenoxy)phenoxy}phenyl]sulfone, 1,4-bis [4-(4-aminophenoxy)phenoxy]-A,α-dimethylbenzyl] benzene, 1,3-bis[4-(4-aminophenoxy)-α,α-dimethylbenzyl] benzene, etc. These may be used alone or in combination of two or more.

A polyimide precursor (polyamic acid) can be obtained by polymerizing a substantially equimolar amount of the aromatic polycarboxylic acid anhydride component and the diamine component in an organic polar solvent such as N,N-dimethylacetamide or N-methyl-2-pyrrolidone, at the reaction temperature of −20 to 100° C., preferably 60° C. or less, and for the reaction time of about 30 minutes to 12 hours.

Conversion (imidization) of the polyimide precursor, polyamic acid, into polyimide is performed.

The polyamic acid can be imidized by a heating method (1) or a chemical method (2). The heating method (1) is a method of converting the polyamic acid into polyimide by heating it at 300 to 400° C., and is a simple and practical method for obtaining a polyimide (polyimide resin). On the other hand, the chemical method (2) is a method of reacting a polyamic acid with a dehydration cyclization reagent (a mixture of a carboxylic acid anhydride and a tertiary amine) and then heat-treating it to completely imidize it. The method (1) is preferable because the chemical method (2) is a more complicated and costly method than the heating method (1).

(Polyurea)

In the synthesis of polyurea used in the present invention, a diamine monomer and an acid component monomer are used as raw material monomers.

The diamine monomer that can be preferably used in the present invention is an aromatic, alicyclic, or aliphatic diamine monomer such as 4,4'-methylenebis(cyclohexylamine), 4,4'-diaminodiphenylmethane, 4,4'-diaminodiphenyl ether, and the like.

On the other hand, the acid component monomer that can be preferably used include that are aromatic, alicyclic, aliphatic diisocyanates such as 1,3-bis(isocyanatomethyl) cyclohexane, 4,4'-diphenylmethane diisocyanate, and the like.

In the present invention, although not particularly limited, it is preferable to use, as the raw material monomer, at least one raw material monomer of the diamine monomer and the acid component monomer preferably contains fluorine.

Preferably used diamine monomers including fluorine include, for example, 4,4'-(hexafluoroisopropylidene)dianiline, 2,2'-bis(trifluoromethyl)benzidine, 2,2'-bis(4-(4-aminophenoxy)phenyl)hexafluoropropane, and the like.

Preferably used acid component monomer including fluorine include, for example, 4,4'-(hexafluoroisopropylidene) bis(isocyanatobenzene), and the like.

[2.4.2] Method for Forming Organic Protective Layer

The formation of the organic protective layer using polyparaxylylene or its derivative, polyimide, and polyurea is not particularly limited and can be formed by the followings: a dry process such as vacuum deposition method, sputtering method, reactive sputtering method, molecular beam epitaxy method, cluster ion beam method, ion plating method, plasma polymerization method, atmospheric pressure plasma polymerization method, plasma CVD method, laser CVD method, thermal CVD method; a coating method such as spin coating, casting, and clavier coating; and a wet process such as printing method including inkjet printing method.

Among them, the vacuum deposition method is preferably used. For example, an organic protective layer made of polyparaxylylene or its derivative is formed on the metal wiring and the base layer in a vacuum device by setting it at a high vacuum of about 0.1 to 10 Pa and heating the raw material monomers of respective evaporation sources to respective predetermined temperatures. Then, after each of the raw material monomers has reached the predetermined temperature and a required evaporation amount is obtained, the vapor of each raw material monomer is introduced into the vacuum chamber and guided to and deposited on the metal wiring.

For example, a parylene layer is preferably formed by supplying Parylene N first and then supplying Parylene C. As a result, it is possible to easily obtain a metal wiring protection layer that has fewer pinholes, excellent heat resistance, and sufficient durability. From these points, it is particularly preferable as a parylene layer for protecting the metal wiring of the inkjet head.

In the parylene layer, the content of parylene N is preferably 50 mol % or less. Thereby, a parylene layer having more excellent heat resistance can be obtained.

Furthermore, when the parylene layer is divided into two layers by the layer thickness, one being a lower layer on the base layer side and another being an upper layer on the opposite side of the base layer, the lower layer preferably contains 70 mol % or more of the parylene N component, and the upper layer preferably contains 70 mol % or more of the parylene C component. This makes it possible to obtain a parylene layer having fewer pinholes, excellent heat resistance, and sufficient durability.

The layer thickness of the organic protective layer is preferably 1 to 20 μm, more preferably 1 to 10 μm, and particularly preferably 5 to 10 μm. In particular, when the layer thickness of the organic protective layer is 1 to 20 μm or less, it is possible to obtain an inkjet head having excellent ink ejection performance.

[2.4.2] Adhesive Layer

In the present invention, an adhesive layer containing a silane coupling agent as an adhesive layer is preferably present between the base layer and the organic protective layer from the viewpoint of adhesion. The silane coupling agent can further improve the adhesion by forming a siloxane bond with the oxide or nitride of silicon in the base layer according to the present invention.

As an embodiment of this, it is preferable not only to form an adhesive layer containing a silane coupling agent as a main component, but also to include a silane coupling agent dispersed in the organic protective layer. The organic protective layer thus obtained has the excellent layer performance, and at the same time, has excellent adhesion to the metal wiring and the base layer and high durability.

For example, in the organic protective layer, it is preferable that the Si concentration of the silane coupling agent contained in the range from the interface with the base layer, which is the lower layer, to the thickness of 0.1 μm is 0.1 $mg/cm^3$ or more. As a result, the adhesion between the metal wiring and base layer and the organic protective layer can be further improved.

Furthermore, in the organic protective layer, the Si concentration of the silane coupling agent contained in the range from the interface with the base layer to the thickness of 0.1 μm is preferably 5 $mg/cm^3$ or less. As a result, it is possible to prevent the silane coupling agent from being unnecessarily present near the interface of the organic protective layer and the adhesiveness between the organic protective layer and the base layer from being deteriorated.

The silane coupling agent used in the present invention is not particularly limited, and may be, for example, halogen-containing silane coupling agent (2-chloroethyltrimethoxysilane, 2-chloroethyltriethoxysilane, 3-chloropropyltrimethoxysilane, 3-chloropropyltriethoxysilane, and the like), epoxy group-containing silane coupling agent [2-(3,4-epoxycyclohexyl)ethyltrimethoxysilane, 2-(3,4-epoxycyclohexyl)ethyltriethoxysilane, 3-(3,4-epoxycyclohexyl)propyltrimethoxysilane, 2-glycidyloxyethyltrimethoxysilane, 2-glycidyloxyethyltriethoxysilane, 3-glycidyloxypropyltrimethoxy silane, 3-glycidyloxypropyltriethoxysilane, and the like], amino group-containing silane coupling agent (2-aminoethyltrimethoxysilane, 3-aminopropyltriethoxysilane), 3-aminopropyltriethoxysilane, 2-[N-(2-aminoethyl)amino]ethyltrimethoxysilane, 3-[N-(2-aminoethyl)amino]propyltrimethoxysilane, 3-(2-aminoethyl)amino]propyltriethoxysilane, 3-[N-(2-aminoethyl)amino]propylmethyldimethoxysilane, and the like), mercapto group-containing silane coupling agent (2-mercaptoethyltrimethoxysilane, 3-(mercaptopropyltrimethoxysilane, 3-mercaptopropyltriethoxysilane, and the like), vinyl group-containing silane coupling agent (vinyltrimethoxysilane, vinyltriethoxysilane, and the like), (meth)acryloyl group-containing silane coupling agent (2-methacryloyloxyethyltrimethoxysilane, 2-methacryloyloxyethyltriethoxysilane, 2-acryloyloxyethyltrimethoxysilane, 3-methacryloyloxypropyltrimethoxysilane, 3-methacryloyloxypropyltriethoxysilane, 3-acryloyloxypropyltrimethoxysilane, and the like). Among these, an epoxy group-containing silane coupling agent, a mercapto group-containing silane coupling agent, and a (meth)acryloyl group-containing silane coupling agent are preferably used.

Preferably, the epoxy group-containing silane coupling agent is an organosilicon compound having at least one epoxy group (organic group containing epoxy group) and at least one alkoxysilyl group in the molecule, has good compatibility with the adhesive component, and has optical transparency (for example, substantially transparent).

Specific examples of the epoxy group-containing silane coupling agent include: 3-glycidoxypropyltrialkoxysilane such as 3-glycidoxypropyltrimethoxysilane, and 3-glycidoxypropyltriethoxysilane; 3-glycidoxypropytalkyldialkoxysilane such as 3-glycidoxypropylmethyldiethoxysilane and 3-glycidoxypropylmethyldimethoxysilane; 2-(3,4-epoxycyclohexyl)ethyltrialkoxysilane such as methyltri(glycidyl)silane, epoxycyclohexyl)ethyltrimethoxysilane, and 2-(3,4-epoxycyclohexyl)ethyltriethoxysilane. Among them, 3-glycidoxypropyltrimethoxysilane, 3-glycidoxypropyltriethoxysilane, 3-glycidoxypropylmethyldiethoxysilane, 2-(3,4 epoxycyclohexyl) are preferred from the viewpoint of further improving durability. In particular, 3-glycidoxypropyltrimethoxysilane is preferable. These may be used alone or in combination of two or more.

Preferably, the mercapto group-containing silane coupling agent is an organosilicon compound having at least one mercapto group (organic group containing a mercapto group) and at least one alkoxysilyl group in the molecule, has good compatibility with the other components, and has optical transparency (for example, substantially transparent).

Specific examples of the mercapto group-containing silane coupling agent include: mercapto group-containing low-molecular type silane coupling agent such as 3-mercaptopropyltrimethoxysilane, 3-mercaptopropyltriethoxysilane, and 3-mercaptopropyldimethoxymethylsilane; mercapto group-containing oligomer type silane coupling agent such as such as co-condensate of mercapto group-containing silane compound (for example, 3-mercaptopropyltrimethoxysilane, 3-mercaptopropyltriethoxysilane, and 3-mercaptopropyldimethoxymethylsilane) and an alkyl group-containing silane compound (for example, methyltriethoxysilane, ethyltriethoxysilane, methyltrimethoxysilane, and ethyltrimethoxysilane); and the like. Among them, from the viewpoint of durability, a mercapto group-containing oligomer type silane coupling agent is preferable, a co-condensate of a mercapto group-containing silane compound and an alkyl group-containing silane compound is particularly preferable, and a co-condensation product of 3-mercaptopropyltrimethoxysilane and methyltriethoxysilane is further preferable. These may be used alone or in combination of two or more.

The (meth)acryloyl group-containing silane coupling agent is preferably 1,3-bis(acryloyloxymethyl)-1,1,3,3-tetramethyldisilazane, 1,3-bis(methacryloyloxymethyl)-1,1,3,3-tetramethyldisilazane, 1,3-bis(γ-acryloyloxypropyl)-1,1,3,3-tetramethyldisilazane, 1,3-bis(γ-methacryloyloxypropyl)-1,1,3,3-tetramethyldisilazane, acryloyloxymethylmethyltrisilazane, methacryloyloxymethylmethyltrisilazane, acryloyloxymethylmethyltetrasilazane, methacryloyloxymethylmethyltetrasilazane, acryloyloxymethylmethylpolysilazane, methacryloyloxymethylmethylpolysilazane, 3-acryloyloxypropylmethyltrisilazane, 3-methacryloyloxypropylmethyltrisilazane, 3-acryloyloxypropylmethyltetrasilazane, 3-methacryloyloxypropylmethyltetrasilazane, 3-acryloyloxypropylmethylpolysilazane, 3-methacryloyloxypropylmethylpolysilazane, acryloyloxymethylpolysilazane, methacryloyloxymethylpolysilazane, 3-acryloyloxypropylpolysilazane, or 3-methacryloyloxypropyl polysilazane. Furthermore, from the viewpoint of easy synthesis and identification of the compound, 1,3-bis(acryloyloxymethyl)-1,1,3,3-tetramethyldisilazane, 1,3-bis(methacryloyloxymethyl)-1,1,3,3-tetramethyldisilazane, 1,3-bis(γ-acryloyloxypropyl)-1,1,3,3-tetramethyldisilazane, or 1,3-bis(γ-methacryloyloxypropyl)-1,1,3,3-tetramethyldisilazane are particularly preferable.

Commercially available silane coupling agents include commercially available (meth)acryloyl group-containing silane coupling agents such as KBM-13, KBM-22, KBM-103, KBM-303, KBM-402, KBM-403, KBM-502, KBM-503, KBM-602, KBM-603, KBM-802, KBM-803, KBM-903, KBM-1003, KBM-3033, KBM-5103, KBM-7103, KBE-13, KBE-22, KBE-402, KBE-403, KBE-502, KBE-503, KBE-846, KBE-903, KBE-1003, KBE-3033, KBE-9007, LS-520, LS-530, LS-1090, LS-1370, LS-1382, LS-1890, LS-2750, and LS-3120 (manufactured by Shin-Etsu Chemical Co., Ltd.). These silane coupling agents may be used alone or in combination of two or more.

Adhesive layer containing silane coupling agent can be formed by the followings: a dry process such as vacuum deposition method, sputtering method, reactive sputtering method, molecular beam epitaxy method, cluster ion beam method, ion plating method, plasma polymerization method, atmospheric pressure plasma polymerization method, plasma CVD method, laser CVD method, thermal CVD method; a wet coating method such as spin coating, casting, and clavier coating, and inkjet printing method.

The organic protective layer including the silane coupling agent dispersed therein is preferably formed by a vapor phase synthesis method such as a chemical vapor deposition method in a vapor atmosphere of the silane coupling agent. The organic protective layer thus obtained has the excellent layer performance as an organic protective layer including the silane coupling agent dispersed therein, and at the same time, has excellent adhesion to the base layer and high durability and can be obtained easily and at low cost.

[2.5] Specific Manufacturing Flow of Base Layer and Organic Protective Layer

Figure 9A:
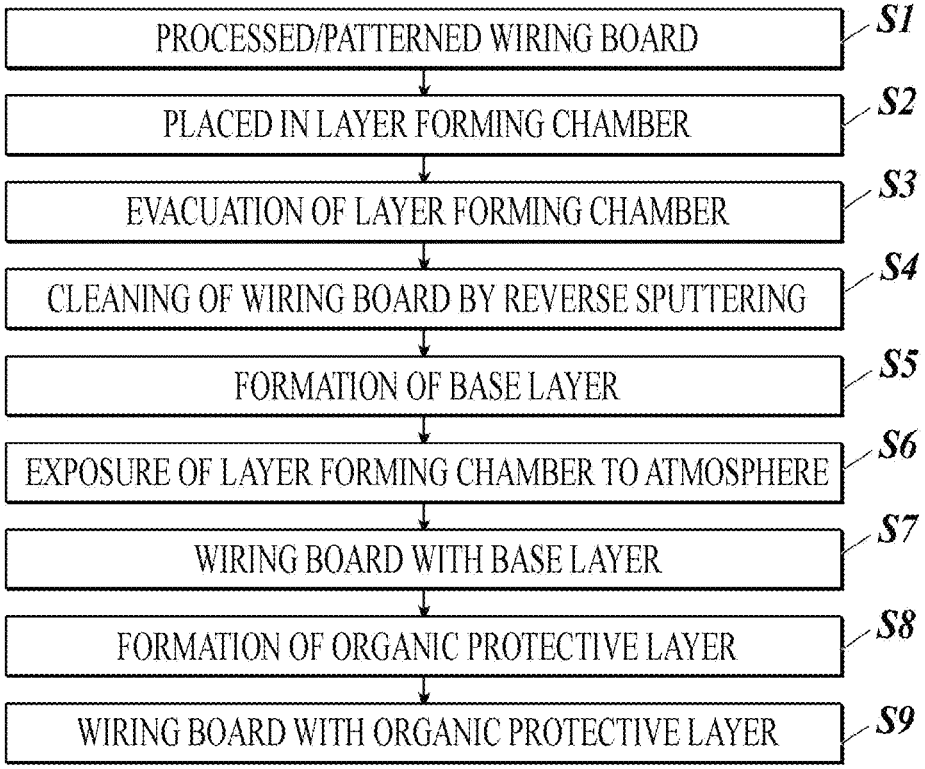
FIG. 9A shows an example of steps of forming a base layer and an organic protective layer on a metal wiring.

FIG. 9A is an example of steps when the base layer and the organic protective layer are formed on the metal wiring.

Step 1 (denoted as S1 in the figure. Described as S1, S2 . . . in the followings) is a step of processing/patterning the metal wiring on a board (details will be described later). The wiring board is placed in the layer forming chamber (S2). After evacuation of the layer forming chamber to $1\times10^{-2}$ Pa or less (S3), the metal wiring board is cleaned by reverse sputtering process as described above (S4). Then, the base layer is formed by a vacuum vapor deposition method (S5). When the base layer include two layers, for example, the first layer is preferably formed by vapor deposition until the layer thickness becomes about 100 nm with Ti as the deposition source, using material gas including oxygen ($O_2$)+nitrogen ($N_2$)+argon (Ar), at the vacuum degree of $1\times10^{-2}$ Pa or less, and at the temperature in the range from room temperature to 200° C.

Next, the second layer is formed by vapor deposition until the layer thickness becomes about 100 nm with Si as the deposition source, using material gas including oxygen ($O_2$)+nitrogen ($N_2$)+argon (Ar), at the vacuum degree of $1\times10^{-2}$ Pa or less, and at the temperature in the range from room temperature to 200° C. Next, the layer forming chamber is exposed to the atmosphere (S6). The metal wiring board with the base layer including two layers is thereby obtained (S7). Similar to the formation of the base layer, an organic protective layer of parylene having a layer thickness of 1 to 20 μm is formed (S8) by placing the metal wiring board with a base layer in the layer forming chamber, evacuation of the layer forming chamber to about 0.1 to 10 Pa, and controlling the vaporization temperature at 100 to 160° C., the pressure at 0.1 to 10 Pa, and the board temperature from the room temperature to 50° C. Next, the layer forming chamber is exposed to the atmosphere, and metal wiring board with the organic protective layer is thereby obtained (S9).

In this case, in order that the silane coupling agent is present at the interface of the organic protective layer which is in contact with the base layer, an adhesive layer containing a silane coupling agent is preferably formed on the base layer by application or vapor deposition before the organic protective layer formation, or vapor of silane coupling agent is preferably introduced into the layer forming chamber at the early stage of organic protective layer formation.

Figure 9B:
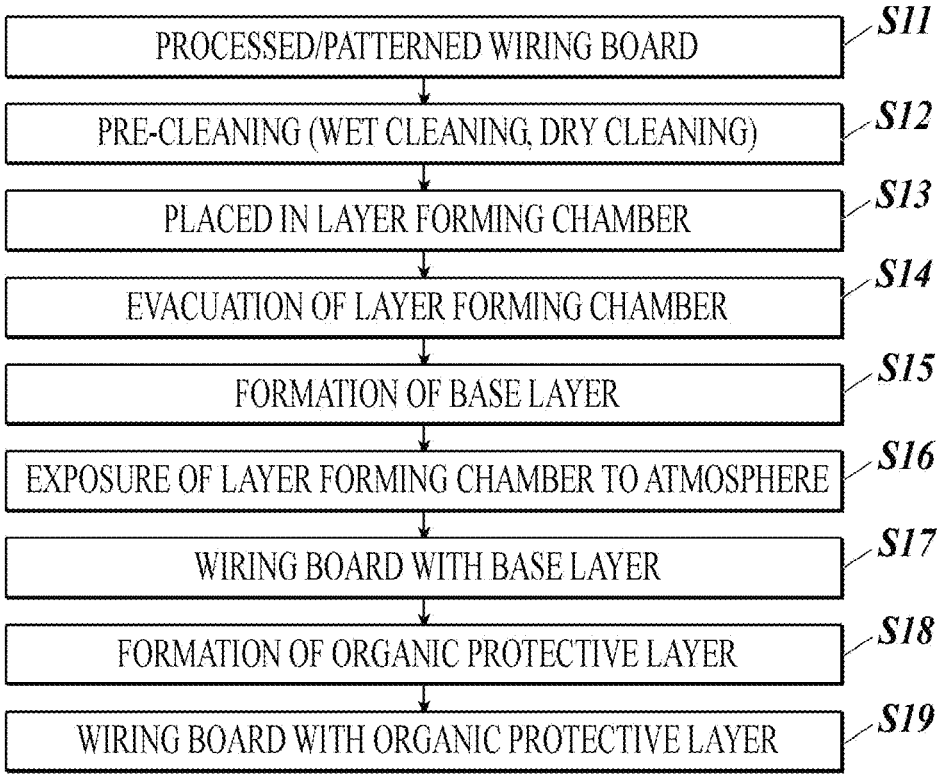
FIG. 9B shows another example of step of forming a base layer and an organic protective layer on a metal wiring.

FIG. 9B is another example of steps when the base layer and the organic protective layer are formed on the metal wiring.

Here, the base layer and the organic protective layer are formed in the same manner as the above steps except that a step of pre-cleaning with isopropyl alcohol and drying (S12) is performed instead of the above-described reverse sputtering process.

Figure 9C:
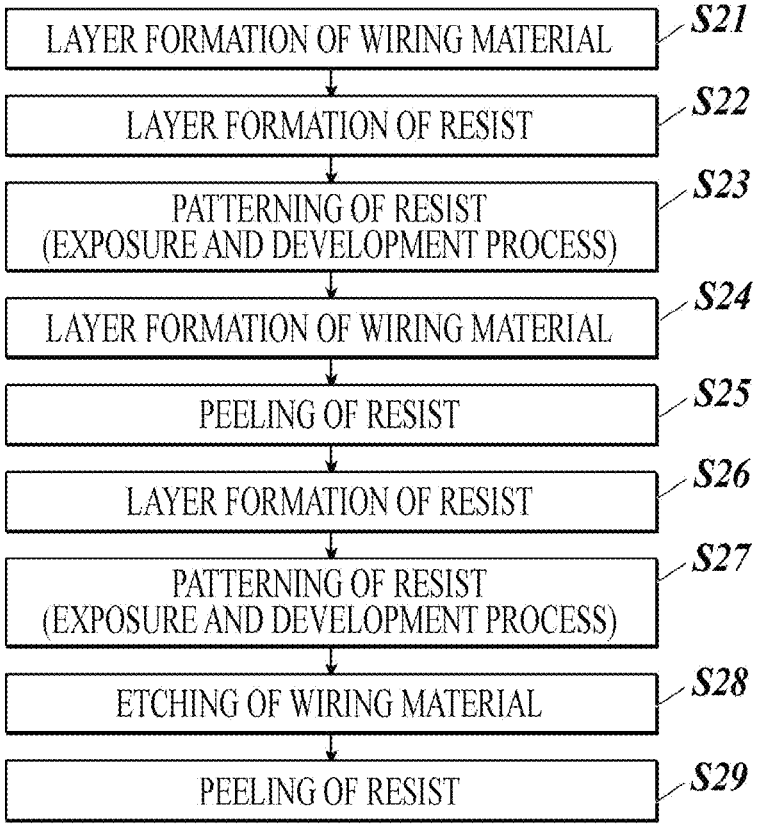
FIG. 9C shows an example of steps of forming a metal wiring.

FIG. 9C is an example of the flow of electrode patterning of the metal wiring shown in FIG. 9A and FIG. 9B.

A patterning method of electrodes by a photolithography method will be described as an example of patterning.

The photolithography method applied to the present invention is a method of processing metal wiring into a desired pattern through the steps of application of resist such as a curable resin, preheating, exposure, development (removal of uncured resin), rinse, etching treatment with an etching solution, and peeling of resist.

Step 21 is a step of layer formation of the metal wiring material. Next, a layer of resist is formed on the material of metal wiring (S22), and the resist is patterned by exposure and development process (S23). For example, the resist may be either a positive type or a negative type. After applying the resist, if necessary, preheating or prebaking can be carried out. At the time of exposure, a pattern mask having a predetermined pattern is arranged and irradiated with light having a wavelength suitable for the used resist (generally, ultraviolet rays, electron beams, etc.).

The resist layer can be applied on the metal wiring layer by a known application method and prebaked with a heating device such as a hot plate or an oven. The known application method may be microgravure coating, spin coating, dip coating, curtain flow coating, roll coating, spray coating, slit coating, or the like. The prebaking can be performed, for example, using a hot plate or the like at a temperature range of 50 to 150° C. and for 30 seconds to 30 minutes.

After exposure, development is performed with a developing solution suitable for the resist used. After the development, the resist pattern is formed by stopping the development and washing with a rinse liquid such as water. Then, after pretreatment or post-baking of the formed resist pattern as needed, etching with an etching solution containing an organic solvent is performed to remove a region not protected by the resist. The etching liquid is preferably a liquid containing an inorganic acid or an organic acid, and oxalic acid, hydrochloric acid, acetic acid or phosphoric acid can be preferably used. After etching, the remaining resist is peeled off to obtain metal wiring having a predetermined pattern.

Next, layer formation of the metal wiring material further performed (S24), the resist is peeled off (S25), layer formation of the resist is performed again (S26), and the resist is patterned by exposure and development process (S27). Then, the material of metal wiring is etched into a desired shape (S28), and the resist is finally peeled off (S29) to obtain patterned metal wiring.

EXAMPLES

Hereinafter, the present invention will be specifically described with reference to examples, but the present invention is not limited thereto.

Example 1

A laminated structure for an inkjet head including the metal wiring, the base layer, and the organic protective layer was produced by the following method.

<Production of Laminated Structure 1>

According to the flow of FIG. 9C, a metal wiring having a thickness of 2 μm and made of gold was formed on a PZT substrate having a thickness of 1 mm. At that time, it was formed by patterning so as to have the shape shown in FIG. 4 through vacuum deposition layer formation using gold, resist layer formation, exposure and development processing, and etching.

Next, without forming the base layer according to the flow of FIG. 9A (excluding S4 to S7), a 10 μm-thick organic protective layer made of polyparaxylylene was produced by a vacuum deposition method. After evacuation to 0.1 Pa, the vacuum vapor deposition was performed at a sublimation temperature of polyparaxylylene of 150° C. and at a pressure of 5 Pa. At that time, using γ-methacryloxypropyltrimethoxysilane as an evaporation source, the gas of the silane coupling agent was introduced at the initial stage of formation of the organic protective layer, such that the Silicon (Si) of the silane coupling agent was contained in an amount of 0.2 mg/cm$^3$ within a thickness of 0.1 μm from the interface of the organic protective layer in contact with the metal wiring. The silicon concentration (Si concentration) in the organic protective layer was analyzed and obtained as follows. Each sample was ashed and then alkali-dissolved with sodium carbonate. The silicon of each sample was quantified by ICP-AES measurement with measurement wavelength of 251.6 nm using SPS3510 (manufactured by Seiko Instruments Inc.).

<Production of Laminated Structure 2>

A laminated structure 2 was prepared according to the flow of FIG. 9A in the same manner as the laminated structure 1, except that the first base layer was a 200 nm-thick polyimide formed on the metal wiring and the second base layer was not provided. The polyimide was formed using a polyimide precursor "UPIA-ST1001 (solid content 18% by mass)" (manufactured by Ube Industries, Ltd.).

<Production of Laminated Structure 3>

A laminated structure 3 was prepared in the same manner as the laminated structure 2, except that the first base layer was a 200 nm-thick silicon oxide formed on the metal wiring by the vacuum deposition method.

<Production of Laminated Structure 4>

A metal wiring was formed on the wiring board in the same manner as the laminated structure 2 by patterning. Next, according to the flow of FIG. 9A, after the reverse sputtering process (20 minutes) with argon (Ar) gas, the first layer was formed by vapor deposition until the layer thickness becomes 100 nm with titanium oxide ($TiO_2$) as the deposition source, using material gas including oxygen ($O_2$)+argon (Ar), at the vacuum degree of $1\times10^{-2}$ Pa, and at the temperature of 170° C. Next, the second base layer was formed by vapor deposition until the layer thickness becomes 100 nm with silicon dioxide ($SiO_2$) as the deposition source, using material gas including oxygen ($O_2$)+argon (Ar), at the vacuum degree of $1\times10^{-2}$ Pa, and at the temperature of 150° C. Two base layers were thus formed. Next, an organic protective layer of polyparaxylylene having a thickness of 10 μm was prepared by the vacuum deposition method. After evacuation to 0.1 Pa, the vacuum vapor deposition was performed at a sublimation temperature of polyparaxylylene of 150° C. and a pressure of 5 Pa. At that time, using γ-methacryloxypropyltrimethoxysilane as an evaporation source, the gas of the silane coupling agent was introduced at the initial stage of formation of the organic protective layer, such that the Silicon (Si) of the silane coupling agent was contained in an amount of 0.2 mg/cm$^3$ within a thickness of 0.1 μm from the interface of the organic protective layer in contact with the metal wiring. The laminated structure 4 was thus produced. As a result of the XPS analysis, the laminated structure 4 had a composition ratio profile as shown in FIG. 6B in the layer thickness direction of the base layer from the interface between the metal wiring and the base layer to the interface between the base layer and the organic protective layer.

<Production of Laminated Structure 5>

A laminated structure 5 was prepared in the same manner as the laminated structure 4, except that the two base layers were formed as follows: the first layer was formed by vapor deposition until the layer thickness becomes 100 nm with aluminum oxide ($Al_2O_3$) as the deposition source, using material gas including oxygen ($O_2$)+argon (Ar), at the vacuum degree of $1\times10^{-2}$ Pa, and at the temperature of 170° C.; and the second base layer was formed by vapor deposition until the layer thickness becomes 100 nm with silicon oxide ($SiO_2$) as the deposition source, using material gas including oxygen ($O_2$)+argon (Ar), at the vacuum degree of $1\times10^{-2}$ Pa, and at the temperature of 150° C. As a result of the XPS analysis, the laminated structure 5 had a composition ratio profile as shown in FIG. 6B in the layer thickness direction of the base layer from the interface between the metal wiring and the base layer to the interface between the base layer and the organic protective layer.

<Production of Laminated Structure 6>

A laminated structure 6 was prepared in the same manner as the laminated structure 4, except that polyimide (polyimide precursor "UPIA-ST1001 (solid content 18% by mass)" (manufactured by Ube Industries, Ltd.) was used as the material of the organic protective layer.

<Production of Laminated Structure 7>

A laminated structure 7 was prepared in the same manner as the laminated structure 4, except that polyurea containing diisocyanate and diamine as monomers was used as the material of the organic protective layer.

<Production of Laminated Structure 8>

A laminated structure 8 was prepared in the same manner as the laminated structure 4, except for the followings. The base layer having a layer thickness of 200 nm was formed with two kinds of elementary substances of titanium (Ti) and silicon (Si) as the deposition sources, using material gas including oxygen ($O_2$)+argon (Ar), at the vacuum degree of $1\times10^{-2}$ Pa. Until the layer thickness reached 150 nm from the surface, the deposition temperature of titanium (Ti) was gradually lowered from 200° C. so that the titanium composition ratio in the layer was gradually decreased. Furthermore, when the thickness of the layer including titanium (Ti) reached 50 nm from the surface, vapor deposition of silicon (Si) was started. at the layer thickness from 50 nm to 200 nm, the vapor deposition temperature was gradually increased from room temperature to 200° C., so that the silicon composition ratio was gradually increased. The obtained base layer was a single base layer having titanium silicate, and the composition ratios of titanium (Ti) and silicon (Si) each had a gradient. As a result of the XPS analysis, the base layer had a composition ratio profile as shown in FIG. 7B in the layer thickness direction of the base layer from the interface between the metal wiring and the base layer to the interface between the base layer and the organic protective layer.

<Production of Laminated Structure 9>

A laminated structure 9 was prepared in the same manner as the laminated structure 4, except that the base layer having a layer thickness of 200 nm was formed with titanium silicate ($TiSi_xO_y$) as the deposition source, using material gas including oxygen ($O_2$)+argon (Ar), at the vacuum degree of $1\times10^{-2}$ Pa, and at the temperature of 170° C. at the highest. The obtained base layer was a single base layer including titanium (Ti) and silicon (Si) each at a uniform composition ratio. As a result of the XPS analysis, the base layer had a composition ratio profile as shown in FIG. 8B in the layer thickness direction of the base layer from the interface between the metal wiring and the base layer to the interface between the base layer and the organic protective layer.

<Production of Laminated Structures 10 and 11>

Laminated structures 10 and 11 were prepared in the same manner as the laminated structure 9, except that the thickness of the base layers were respectively changed to 5 nm and 10 μm, as shown in Table II.

The above laminated structures 1 to 11 were evaluated as follows.

<<Evaluation>>

<Measurement of Composition Distribution in Thickness Direction of Base Layer>

Using XPS analysis, the composition distribution profile was measured in the thickness direction of the base layer (in the layer thickness direction from the interface between the metal wiring and the base layer to the interface between the base layer and the organic protective layer). The XPS analysis conditions are shown below. When the thickness of the base layer was less than 10 nm, the composition ratio of the metal or silicon was determined in a region from the surface (interface) to the thickness. Otherwise, the composition ratio of the metal or silicon existing was determined in a region from the surface (interface) to the thickness of 10 nm. Average composition ratio was used as the composition ratio, which is the average of the values measured from 10 random points of the sample, was used. When contaminants were adsorbed on the surface, XPS analysis was performed after removing the contaminants by surface cleaning or a rare gas ion sputtering method using argon (Ar), if necessary.

<XPS Analysis Condition>

Analyzer: "PHI Quantera SXM" manufactured by ULVAC-PHI

X-ray source: Monochromatic Al-Kα

Sputtering ion: Ar (2 keV)

Depth profile: The depth profile in the depth direction was obtained by repeating measurement at a predetermined thickness interval based on the $SiO_2$ converted sputter thickness. The thickness interval was 1 nm (data was obtained every 1 nm in the depth direction).

Quantification: The background was determined by the Shirley method, and the peak area was quantified using the relative sensitivity coefficient method. Data was processed using MultiPak manufactured by ULVAC-PHI. The analyzed elements were Si, Ti, Al, and O.

<Peeling of Layer Between Metal Wiring and Organic Protective Layer Immediately after Layer Formation>

Adhesion was evaluated by evaluating the peeling of layer between the metal wiring and the organic protective layer immediately after layer formation.

In the evaluation, a polyimide sheet having a width of 2 mm, a length of 50 mm, and a thickness of 50 μm was bonded to the organic protective layer surface of the laminated structure with a two-component curing type epoxy adhesive (Epo-Tec 353ND). The polyimide sheet protruding from the surface of the organic protective layer was grabbed at a portion of 10 mm and pulled in the direction perpendicular to the organic protective layer. When the layer was peeled off, the peeling of the organic protective layer from the metal wiring was visually evaluated. Based on this, the adhesive force (adhesion) of the organic protective layer to the metal wiring was evaluated.

AA: There is no peeling of layer, and adhesion is high.

BB: A part of layer is peeled off, but adhesion is high.

CC: Peeling of layer is observed, and adhesion is low.

<Ink Dipping Test>

The durability against ink was evaluated through observation of the peeling of layer between the metal wiring and the organic protective layer after dipping in ink.

In the evaluation of the above peeling of layer, a water-based alkaline dummy ink of pH 11 at 23° C. was prepared as a water-based inkjet ink, and the laminated structure was immersed therein at a temperature of 30° C. for one week. The aqueous alkaline dummy ink having a pH of 11 is an aqueous solution with pH adjusted to 10 to 11 by mixing buffer solutions such as sodium carbonate and potassium carbonate, and includes polypropylene glycol alkyl ether, dipolypropylene glycol alkyl ether, tripolypropylene glycol alkyl ether, and the like.

AA: There is no peeling of layer, and durability against ink is high.

BB: A part of layer is peeled off, but durability against ink is high.

CC: Peeling of layer is observed, and durability against ink is low.

The above evaluation results are shown in TABLE I and TABLE II.

TABLE I

| | | | Base Layer | | | | | | |
|---|---|---|---|---|---|---|---|---|---|
| | | | First Base Layer | | | Second Base Layer | | | |
| Laminated Structure No. | Material of Metal Wiring | Material | Layer Thickness [nm] | Composition Ratio of Metal [at %] | Composition Ratio of Silicon [at %] | Material | Layer Thickness [nm] | Composition Ratio of Metal [at %] | Composition Ratio of Silicon [at %] |
| 1 | Ag | — | — | — | — | — | — | — | — |
| 2 | Ag | Polyimide | 200 | <1 | <1 | — | — | — | — |
| 3 | Ag | Silicon Dioxide | 200 | <1 | 33.3 | — | — | — | — |
| 4 | Ag | Titanium Oxide | 100 | 33.3 | <1 | Silicon Dioxide | 100 | <1 | 33.3 |
| 5 | Ag | Aluminum Oxide | 100 | 20.0 | <1 | Silicon Dioxide | 100 | <1 | 33.3 |
| 6 | Ag | Titanium Oxide | 100 | 33.3 | <1 | Silicon Dioxide | 100 | <1 | 33.3 |
| 7 | Ag | Titanium Oxide | 100 | 33.3 | <1 | Silicon Dioxide | 100 | <1 | 33.3 |

| | Organic Protective Layer | | Evaluation | | |
|---|---|---|---|---|---|
| Laminated Structure No. | Silane Coupling Agent | Material of Organic Protective Layer | Peeling of Layer Immediately after Layer Formation | Peeling of Layer after Dipping inInk | Remarks |
| 1 | Included | PPX | AA | CC | Comparative Example |
| 2 | Included | PPX | AA | CC | Comparative Example |
| 3 | Included | PPX | CC | Not Evaluated | Comparative Example |
| 4 | Included | PPX | AA | AA | Present Invention |
| 5 | Included | PPX | AA | BB | Present Invention |
| 6 | Included | Polyimide | AA | BB | Present Invention |
| 7 | Included | Polyurea | AA | BB | Present Invention |

PPX: Poly-para-xylylene

TABLE II

| | | Single Base Layer | | | | | | |
|---|---|---|---|---|---|---|---|---|
| | | | | | Interface with Metal Wiring | | Interface with Organic Protective Layer | |
| Laminated Structure No. | Material of Metal Wiring | Material | Layer Thickness | Layer Structure | Composition Ratio of Metal [at %] | Compostion Ratio of Silicon [at %] | Composition Ratio of Metal [at %] | Composition Ratio of Silicon [at %] |
| 8 | Ag | Titanium/ Silicon | 200 nm | Gradient Composition Ratio | 33.3 | <1 | <1 | 33.3 |
| 9 | Ag | Titanium Silicate | 200 nm | Uniform Composition Ratio | 16.7 | 16.7 | 16.7 | 16.7 |
| 10 | Ag | Titanium Silicate | 5 nm | Uniform Composition Ratio | 16.7 | 16.7 | 16.7 | 16.7 |
| 11 | Ag | Titanium Silicate | 10 μm | Uniform Composition Ratio | 16.7 | 16.7 | 16.7 | 16.7 |

TABLE II-continued

| | Organic Protective Layer | | Evaluation | | |
|---|---|---|---|---|---|
| Laminated Structure No. | Silane Coupling Agent | Material of Organic Protective Layer | Peeling of Layer Immediately after Layer Formation | Peeling of Layer after Dipping inInk | Remarks |
| 8 | Included | PPX | AA | AA | Present Invention |
| 9 | Included | PPX | AA | AA | Present Invention |
| 10 | Included | PPX | AA | BB | Present Invention |
| 11 | Included | PPX | BB | Not Evaluated | Present Invention |

PPX: Poly-para-xylylene

The results of TABLE I and TABLE II show that, when the base layer according to the present invention is arranged between the metal wiring and the organic protective layer, the adhesion between the metal wiring and the organic protective layer formed on the metal wiring is significantly improved. According to the present invention, the durability of the metal wiring to ink is improved as compared with the comparative example.

The excellent effect of the present invention can be exhibited even when the base layer has a two-layer structure (laminated structure 4) or is a single base layer in which the composition ratios of metal and silicon have gradients (laminated structure 8) or are uniform (laminated structure 9).

Regarding laminated structure 5, there was no peeling of layer, but elution of the aluminum oxide layer was observed.

Regarding the laminated structure 11 with a base layer having a thickness of 10 μm, because of the rather high layer stress, peeling of layer and warpage of the board were partially observed.

Example 2

A laminated structure 12 was prepared in the same manner as the laminated structure 4 in EXAMPLE 1, except that the reverse sputtering process with argon (Ar) gas shown in FIG. 9A was not performed. As a result, in 2 out of 10 samples of laminated structure 12, peeling of layer immediately after layer formation occurred. Thus, the laminated structure 12 was slightly inferior in adhesion to the laminated structure 4.

Example 3

Laminated structures 13 and 14 were prepared in the same manner as the laminated structure 4 in EXAMPLE 1, except that gold as the metal wiring material was respectively changed to platinum and copper, but the result was the same as that of EXAMPLE 1. It was confirmed that even if the metal of the metal wiring was changed, the adhesion between the metal wiring and the organic protective layer formed thereon was significantly improved, and the ink durability of the metal wiring was improved.

Example 4

A laminated structure 15 was prepared in the same manner as the laminated structure 4 in EXAMPLE 1, except that the titanium nitride (TiN) was used instead of titanium oxide, silicon nitride ($Si_3N_4$) was used instead of silicon dioxide, and the material gas was nitrogen ($N_2$)+argon (Ar). Then, the peeling of layer after dipping in ink was evaluated to be BB, which proves that a part of the layer was peeled off, but durability against ink was high.

INDUSTRIAL APPLICABILITY

In the inkjet head of the present invention, the adhesion between the metal wiring and the organic protective layer formed thereon is significantly improved, and the durability of the metal wiring to ink is improved. Therefore, the inkjet head can be preferably used for consumer and commercial inkjet devices.

The invention claimed is:

1. An inkjet head having a metal wiring on a board in an ink flow path or an ink tank, comprising a base layer and an organic protective layer on the metal wiring, arranged in an order of the metal wiring, the base layer, and the organic protective layer, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride, metal of the at least one the metal oxide and the metal nitride is titanium, zirconium, tantalum, chromium, or nickel.

2. The inkjet head according to claim 1, wherein the base layer has a laminated structure including two or more layers, one of the two or more layers is in contact with the metal wiring and includes at least one of a metal oxide and a metal nitride, and another of the two or more layers is in contact with the organic protective layer and includes at least one of a silicon oxide and a silicon nitride.

3. The inkjet head according to claim 1, wherein the base layer includes a mixture of the metal oxide or metal nitride and the silicon oxide or silicon nitride, and at least one of a composition ratio of the metal and a composition ratio of the silicon has a gradient in a layer thickness direction.

4. The inkjet head according to claim 1, wherein the base layer includes a mixture of the metal oxide or metal nitride and the silicon oxide or silicon nitride, and both a composition ratio of the metal and a composition ratio of the silicon are uniform in a layer thickness direction.

5. The inkjet head according to claim 1, wherein, in the base layer, a composition ratio of the metal at an interface that is in contact with the metal wiring is in a range of 1 to 50 at %, and a composition ratio of the silicon at an interface that is in contact with the organic protective layer is in a range of 1 to 50 at %.

6. The inkjet head according to claim 1, wherein the base layer has a layer thickness within a range of 0.1 nm to 10 μm.

7. The inkjet head according to claim 1, wherein metal of the metal wiring is gold, platinum or copper.

8. The inkjet head according to claim 1, wherein the silicon oxide is silicon dioxide.

9. The inkjet head according to claim 1, wherein the organic protective layer includes a silane coupling agent or is adjacent to an adhesive layer including a silane coupling agent, the adhesive layer being between the organic protective layer and the base layer.

10. The inkjet head according to claim 1, wherein the organic protective layer includes polyparaxylylene, derivative of polyparaxylylene, polyimide, or polyuria.

11. A method of producing the inkjet head according to claim 1, comprising, in formation of the base layer, a pretreatment including degreasing cleaning, plasma treatment, or reverse sputtering treatment.

12. An inkjet head having a metal wiring on a board in an ink flow path or an ink tank, comprising a base layer and an organic protective layer on the metal wiring, arranged in an order of the metal wiring, the base layer, and the organic protective layer, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride, wherein the base layer has a laminated structure including two or more layers, one of the two or more layers is in contact with the metal wiring and includes at least one of a metal oxide and a metal nitride, and another of the two or more layers is in contact with the organic protective layer and includes at least one of a silicon oxide and a silicon nitride.

13. An inkjet head having a metal wiring on a board in an ink flow path or an ink tank, comprising a base layer and an organic protective layer on the metal wiring, arranged in an order of the metal wiring, the base layer, and the organic protective layer, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride, wherein the base layer includes a mixture of the metal oxide or metal nitride and the silicon oxide or silicon nitride, and at least one of a composition ratio of the metal and a composition ratio of the silicon has a gradient in a layer thickness direction.

14. An inkjet head having a metal wiring on a board in an ink flow path or an ink tank, comprising a base layer and an organic protective layer on the metal wiring, arranged in an order of the metal wiring, the base layer, and the organic protective layer, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride, wherein the organic protective layer includes a silane coupling agent or is adjacent to an adhesive layer including a silane coupling agent, the adhesive layer being between the organic protective layer and the base layer.

15. A method for producing an inkjet head having a metal wiring on a board in an ink flow path or an ink tank, comprising a base layer and an organic protective layer on the metal wiring, arranged in an order of the metal wiring, the base layer, and the organic protective layer, the method comprising:

in formation of the base layer, a pretreatment including degreasing cleaning, plasma treatment, or reverse sputtering treatment, wherein the base layer has an interface that is in contact with the metal wiring and that includes at least one of a metal oxide and a metal nitride, and the base layer has an interface that is in contact with the organic protective layer and that includes at least one of a silicon oxide and a silicon nitride, the method comprising:

in formation of the base layer, a pretreatment including degreasing cleaning, plasma treatment, or reverse sputtering treatment.

* * * * *